US005263544A

United States Patent [19]

White

[11] Patent Number: 5,263,544

[45] Date of Patent: * Nov. 23, 1993

[54] SHOCK ABSORBING APPARATUS AND METHOD FOR A VIBRATORY PILE DRIVING MACHINE

[75] Inventor: John L. White, Federal Way, Wash.

[73] Assignee: American Piledriving Equipment, Inc., Seattle, Wash.

[ * ] Notice: The portion of the term of this patent subsequent to Jun. 2, 2009 has been disclaimed.

[21] Appl. No.: 701,502

[22] Filed: May 16, 1991

Related U.S. Application Data

[63] Continuation-in-part of Ser. No. 465,464, Jan. 16, 1990, Pat. No. 5,117,925, which is a continuation-in-part of Ser. No. 464,429, Jan. 12, 1990, abandoned.

[51] Int. Cl.[5] ..... E02D 7/18; E21B 7/24

[52] U.S. Cl. ..... 173/162.1; 173/49; 175/56; 405/232

[58] Field of Search ..... 173/49, 162.1; 175/56, 175/171; 405/232, 228, 175

[56] References Cited

U.S. PATENT DOCUMENTS

| | | | |
|---|---|---|---|
| 3,004,389 | 11/1961 | Müller | 175/56 |
| 3,460,637 | 8/1969 | Schulin | 175/56 |
| 3,828,864 | 8/1974 | Haverkamp et al. | 173/162.1 |
| 3,865,501 | 2/1975 | Kniep | 175/156 |
| 4,274,616 | 6/1981 | Boguth | 173/162.1 |
| 4,645,017 | 2/1987 | Bodine | 173/162.1 |
| 5,117,925 | 6/1992 | White | 173/49 |

FOREIGN PATENT DOCUMENTS

| | | | |
|---|---|---|---|
| 0362158 | 4/1990 | European Pat. Off. | 175/56 |

*Primary Examiner*—Hien H. Phan
*Attorney, Agent, or Firm*—Hughes & Multer

[57] ABSTRACT

The specification discloses an apparatus for driving and/or pulling a pile which basically comprises vibratory device, a pulling device, a plurality of shock absorbing members, and shock connecting apparatus. The vibratory device generates a vibratory force and applies this force to the pile. The pulling device applies a tension load to a carrying member. The shock connecting apparatus is operatively connected to the carrying member, the shock absorbing members, and the vibratory device. The shock connecting apparatus so selectively connects each of the plurality of shock absorbing members between the vibratory device and the pulling device that the total shock absorbing capacity of the apparatus is incrementally increased as the tension load applied to the carrying member increases.

11 Claims, 15 Drawing Sheets

166
168
112
206
208
132
116
202
130
134
136
128
138
140
204
180
182
114
170

124
116
126
126
138
140
176
114
170

118
120
148
150
176
114
170

166
168
112
206
134
208
136
132
116
202
138
140
130
128
204
182
180
114
170

124
126
138
126
140
116
176
114
170

118
120
148
150
176
114
170

SHOCK ABSORBING APPARATUS AND METHOD FOR A VIBRATORY PILE DRIVING MACHINE

CROSS-REFERENCE TO RELATED CASE

This patent application is a continuation-in-part of U.S. Pat. application Ser. No. 07/465,464 filed Jan. 16, 1990, by John L. White, which is entitled "Shock Absorbing Apparatus and Method for a Vibratory Pile Driving Machine," now U.S. Pat. No. 5,117,925, which is in turn a continuation-in-part of U.S. Pat. application Ser. No. 07/464,429 filed Jan. 12, 1990 which has been abandoned.

BACKGROUND OF THE INVENTION

A) Field of the Invention

The present invention relates to a shock absorbing apparatus and method to be used in conjunction with a pile driving and/or pile pulling vibratory machine, and more particularly to such an apparatus and method which can be used effectively to isolate shocks under greatly varying load conditions imparted to the shock absorbing apparatus.

b) Background of the Invention

In the construction industry, it is sometimes necessary to drive piles into the earth to provide a proper foundation for a building or other structure. One method of accomplishing this is to place the pile in a vertical position above the earth's surface and strike the upper end of the pile repeatedly with a hammer (i.e., a metal mass which is raised and dropped on the pile) until the pile has penetrated into the ground surface a sufficient distance to provide adequate bearing. A later development was to drive piles into the ground by use of a vibrating machine which oscillates the pile from zero to 20,000 cycles per minute depending on the type of machine to cause what appears to be an almost continuous motion of the pile into the earth. Under some circumstances, such a vibratory machine can cause the pile to move into the earth relatively rapidly (e.g., as fast as ten feet per second).

A typical arrangement for such a vibratory machine is to provide a pair of weights which are mounted eccentrically for rotation about parallel axes, with the directions of rotation being opposite to one another so that the lateral forces are being cancelled out, and a net up and down vibrating force is developed by the machine. One part of the machine is coupled to the upper end of the pile, while a second part of the machine is connected through a shock absorbing device to a support member, such as a cable.

When the pile is being driven into the ground, the vibratory machine is able, in large part, to act substantially independently, in that only minimal exterior support is required, this being mainly to keep the vibratory machine properly positioned. Sometimes weights are added to the shock absorbing device to provide a greater downward force, and this gives need for effective shock absorption. Another mode of operation is when a previously driven pile is being extracted from the earth, and it is necessary to impart a tension force on the pile so as to pull it upwardly. In these circumstances, a tension force (e.g., a pulling force exerted by a connecting cable) is applied through the shock absorbing device to the vibratory machine, which in turn pulls upwardly on the pile to which it is connected. The tension force exerted by the cable can vary greatly, and can vary between two tons to one hundred tons.

For various reasons, it is desirable that the cable be subjected to a more constant load, with the rapid vibratory loads being isolated from the cable as much as possible. However, properly isolating these vibratory loads is complicated by the fact that the tension loads necessary to extract the pile can vary greatly, depending upon the size of the pile, the depth to which it is driven, and the localized resisting forces imparted by various portions of the earth material.

OBJECTS OF THE INVENTION

From the foregoing, it should be apparent that one important object of the present invention is to provide improved apparatus and methods for pulling and/or driving piles.

Other important, but more specific, objectives of the present invention are to provide apparatus and methods for pulling and/or driving piles that:

substantially isolate the vibration of the vibratory pile driver from a cable suspended from a crane that positions the pile driver;

efficiently isolate the cable from the pile driver over a wide range of tension forces applied on the cable by the crane; and employ a plurality of sets of shock absorbing members, where one set of shock absorbing members primarily absorbs shock for relatively lower tension loads and other sets of shock absorbing members are added to absorb shock at relatively higher tension loads.

SUMMARY OF THE INVENTION

These and other objects are achieved by an apparatus for driving and/or pulling a pile which basically comprises vibrating means, pulling means, a plurality of shock absorbing members, and shock connecting means. The vibrating means generates a vibratory force and applies this force to the pile. The pulling means applies a tension load to a carrying member. The shock connecting means is operatively connected to the carrying member, the shock absorbing members, and the vibrating means.

The shock connecting means so selectively connects each of the plurality of shock absorbing means between the vibratory device and the pulling means that the total shock absorbing capacity of the apparatus is incrementally increased as the tension load applied to the carrying member increases.

In the preferred embodiments, each of the plurality of shock absorbing means is adapted to absorb shock in a predetermined range of tension loads. In this case, the shock connecting means so distributes the vibratory force generated by the vibrating means among the plurality of shock absorbing means that, when the load applied to the carrying member is within a given predetermined ranges of tension loads, the vibratory force is resisted primarily by shock absorbing means adapted to absorb shock in that given predetermined range.

In the first and second embodiments, the apparatus comprises first and second shock absorbing means. The shock connecting means are operatively connected to the first and second shock absorbing means to so distribute the vibratory force from the vibrating means to the first and second shock absorbing means that, when the load applied to the carrying member is relatively smaller, the vibratory force is resisted primarily by the first shock absorbing means and, when the load applied to the carrying member is relatively larger, the vibratory force is resisted primarily by the second shock absorbing means.

In the third embodiment, the apparatus comprises first, second, and third shock absorbing means for absorbing the vibratory force generated by the vibratory device. In this case, the shock connecting means operatively connects: (a) the first shock absorbing means between the base section and the connecting section; (b) the second shock absorbing means between the base section and the connecting section above a first predetermined tension load; and (e) the third shock absorbing means between the base section and the connecting section above a second predetermined tension load.

According to the second embodiment, the present invention is embodied in a shock absorbing apparatus adapted to be connected between a pile driving and/or pile pulling vibratory device which generates a vibratory force and imparts the vibratory force to a pile and a carrying member for supporting the vibratory device. This apparatus comprises: (a) a base section adapted to be connected to one of the carrying member and the vibratory device; (b) a connecting section adapted to be connected to the other of the carrying member and the vibratory device; (c) an intermediate section; (d) first shock absorbing means operatively connected between the base section and the connecting section for absorbing the vibratory force generated by the vibratory device; (e) second shock absorbing means operatively connected between the intermediate section and the connecting section for absorbing the vibratory force generated by the vibrating device; and (f) first stop means for limiting relative movement between the intermediate section and the base section. A tension load is applied to the carrying member which causes a relative displacement between the connecting section and the base section.

In the second preferred embodiment, the vibratory force is absorbed primarily by the first shock absorbing means at relatively smaller loads and primarily by the second shock absorbing means at relatively larger loads. Further, the first stop means so limits relative movement between the intermediate section and the base section that, under a first predetermined load, the intermediate and base sections come into essentially rigid contact with each other.

The apparatus of the second preferred embodiment further comprises second stop means for so limiting relative movement between the intermediate section and the connecting section that, under a second predetermined load, the intermediate and connecting sections come into essentially rigid contact with each other. In this case, the second predetermined load is greater than the first predetermined load.

The present invention may also be embodied in an apparatus for pulling and/or driving a pile, comprising: (a) vibrating means for generating a vibrating force and applying the vibrating force to the pile; (b) pulling means for applying a tension load to a carrying member; (c) a shock absorbing apparatus having first and second sets of shock absorbing members and an intermediate member, the first set of shock absorbing members being operatively connected between the vibrating means and the carrying member and the second set of shock absorbing members being operatively connected between the carrying member and the intermediate member; and (d) first stop means for so limiting relative movement between the vibrating means and the intermediate member that, when the load applied to the carrying member is relatively smaller, the vibrating force is absorbed primarily by the first set of shock absorbing members and, when the load applied to the carrying member is relatively larger, the vibrating force is absorbed primarily by the second set of shock absorbing members. The shock absorbing apparatus further comprises second stop means for so limiting movement of the vibrating means relative to the intermediate member when the load is relatively larger that the vibratory motion generated by the vibratory device is substantially transmitted from the base section to the connecting section through the intermediate section.

The present invention may also be embodied in a method of pulling and/or driving a pile, comprising the steps of: (a) providing a shock absorbing apparatus having an intermediate section and first and second sets of shock absorbing members; (b) operatively connecting the first set of shock absorbing members between a pulling device and a vibrating device; (c) operatively connecting the second set of shock absorbing members between the intermediate member and the pulling device; (d) simultaneously applying a tension load on the shock absorbing apparatus with the pulling means and applying a vibratory force to the pile with the vibrating means; and (e) limiting the movement of the vibrating means relative to the intermediate member at a first predetermined load so that the vibratory force is substantially absorbed by the second shock absorbing member. This method further comprises the step of so limiting movement of the pulling means relative to the intermediate member at a second predetermined load that the vibratory force is transmitted to the pulling device through the intermediate section.

According to the third embodiment of the present invention, the shock absorbing apparatus comprises: (a) a base section adapted to be . connected to one of the carrying member and the vibratory device; (b) a connecting section adapted to be connected to the other of the carrying member and the vibratory device, where tension loads are applied to the carrying member which cause a relative displacement between the connecting section and the base section; (c) first shock absorbing means operatively connected between the base section and the connecting section for absorbing the vibratory force generated by the vibratory device; (d) second shock absorbing means connected between the base section and the connecting section above a first predetermined tension load for absorbing the vibratory force generated by the vibrating device; and (e) third shock absorbing means connected between the base section and the connecting section above a second predetermined tension load for absorbing the vibratory force generated by the vibrating device. The third embodiment further comprises stop means for so limiting relative movement between the base section and the connecting section that, under a third predetermined load, the intermediate and connecting sections come into essentially rigid contact with each other.

The third embodiment further comprises an intermediate section attached to the base section. In this case, (a) the connecting section has a center cavity having front and back inner walls; (b) the second and third shock absorbing means each comprise at least one shock absorbing unit connected between the front and back inner walls of the center cavity; and (c) the intermediate section so extends into the center cavity that the at least one shock absorbing unit of the second shock absorbing means extends through at least one corresponding first slot in the intermediate section and the at least one shock absorbing unit of the third shock absorbing means extends through at least one second slot in the intermediate section. The first slot is formed with at least one edge which contacts and distorts the at least one shock absorbing unit of the second shock absorbing means at tension loads greater than the first predetermined tension load and the second slot is formed with at least one edge which contacts and distorts the at least one shock absorbing unit of the third shock absorbing means at tension loads greater than the second predetermined tension load.

The third embodiment may also be embodied in a method of preventing shock generated by a pile driving and/or pile pulling vibratory device which generates a vibratory force and imparts the vibratory force to a pile from being transmitted to a carrying member for supporting the vibratory device. This method comprises the steps of: (a) providing a base section adapted to be connected to one of the carrying member and the vibratory device; (b) providing a connecting section adapted to be connected to the other of the carrying member and the vibratory device, where tension loads are applied to the carrying member which causes a relative displacement between the connecting section and the base section; (c) operatively connecting a first shock absorbing means for absorbing the vibratory force generated by the vibratory device between the base section and the connecting section; (d) operatively connecting a second shock absorbing means for absorbing the vibratory force generated by the vibrating device between the base section and the connecting section above a first predetermined tension load; and (e) operatively connecting a third shock absorbing means for absorbing the vibratory force generated by the vibrating device between the base section and the connecting section above a second predetermined tension load.

This method further comprises the step of so limiting relative movement between the base section and the connecting section that, under a third predetermined load, the intermediate and connecting sections come into essentially rigid contact with each other.

More particularly, this method of the third embodiment further comprises the steps of: (a) attaching an intermediate section to the base section, where the connecting section is provided with a center cavity having front and back inner walls and the intermediate section extends into the center cavity; (b) forming at least one first slot in the intermediate section; and (c) forming at least one second slot in the intermediate section. The second and third shock absorbing means each comprise at least one shock absorbing unit connected between the front and back inner walls of the center cavity. The intermediate section so extends into the center cavity that the at least one shock absorbing unit of the second shock absorbing means extends through the at least one corresponding first slot in the intermediate section and the at least one shock absorbing unit of the third shock absorbing means extends through the at least one second slot in the intermediate section. Finally, the first slot is formed with at least one edge which contacts and distorts the at least one shock absorbing unit of the second shock absorbing means at tension loads greater than the first predetermined tension load and the second slot is formed with at least one edge which contacts and distorts the at least one shock absorbing unit of the third shock absorbing means at tension loads greater than the second predetermined tension load.

DESCRIPTION OF THE PREFERRED EMBODIMENTS

First Embodiment of the Invention

Figure 1:
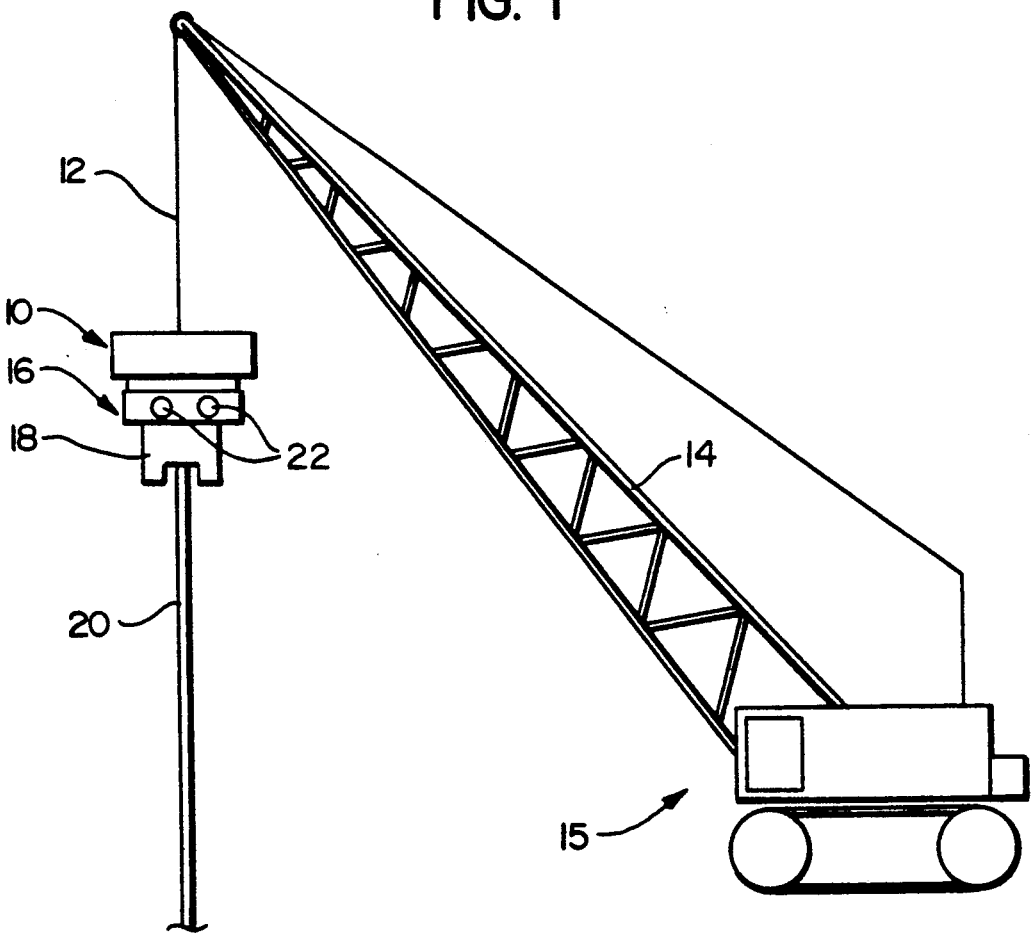
FIG. 1 is a side elevational view, showing the shock absorbing apparatus of the present invention somewhat schematically in its operating environment where it is suspended from, a crane and connected to a vibratory machine engaging a pile.

With reference to FIG. 1, the shock absorbing apparatus 10 of the first embodiment of the present invention is shown connected to a cable 12 which is in turn carried by a boom 14 of a crane 15. The shock absorbing apparatus is connected on its lower side to a vibratory machine 16 which has a jaw mechanism 18 that grips the upper end of a pile 20. This vibrating machine 16 is or may be of conventional design, and there is shown schematically a pair of eccentrically mounted weights 22 which rotate about parallel axes in opposite directions so as to cause a net up and down vibrating force.

As indicated previously, when the pile 20 is being driven, there may be little, if any, tension placed on the cable 12. However, if the pile 20 is being pulled out of the earth, then it may be necessary to exert a quite substantial tension force on the cable 12 (e.g., as high as two tons to one hundred tons), while the vibrating machine 16 imparts the vibrating force to the pile 20. Under these circumstances (i.e., when the pile 20 is being pulled from the earth), it is particularly desirable that the shock absorbing apparatus 10 isolate the cable 12 (and consequently the boom 14 and crane 15) from the vibratory forces.

Figure 2:
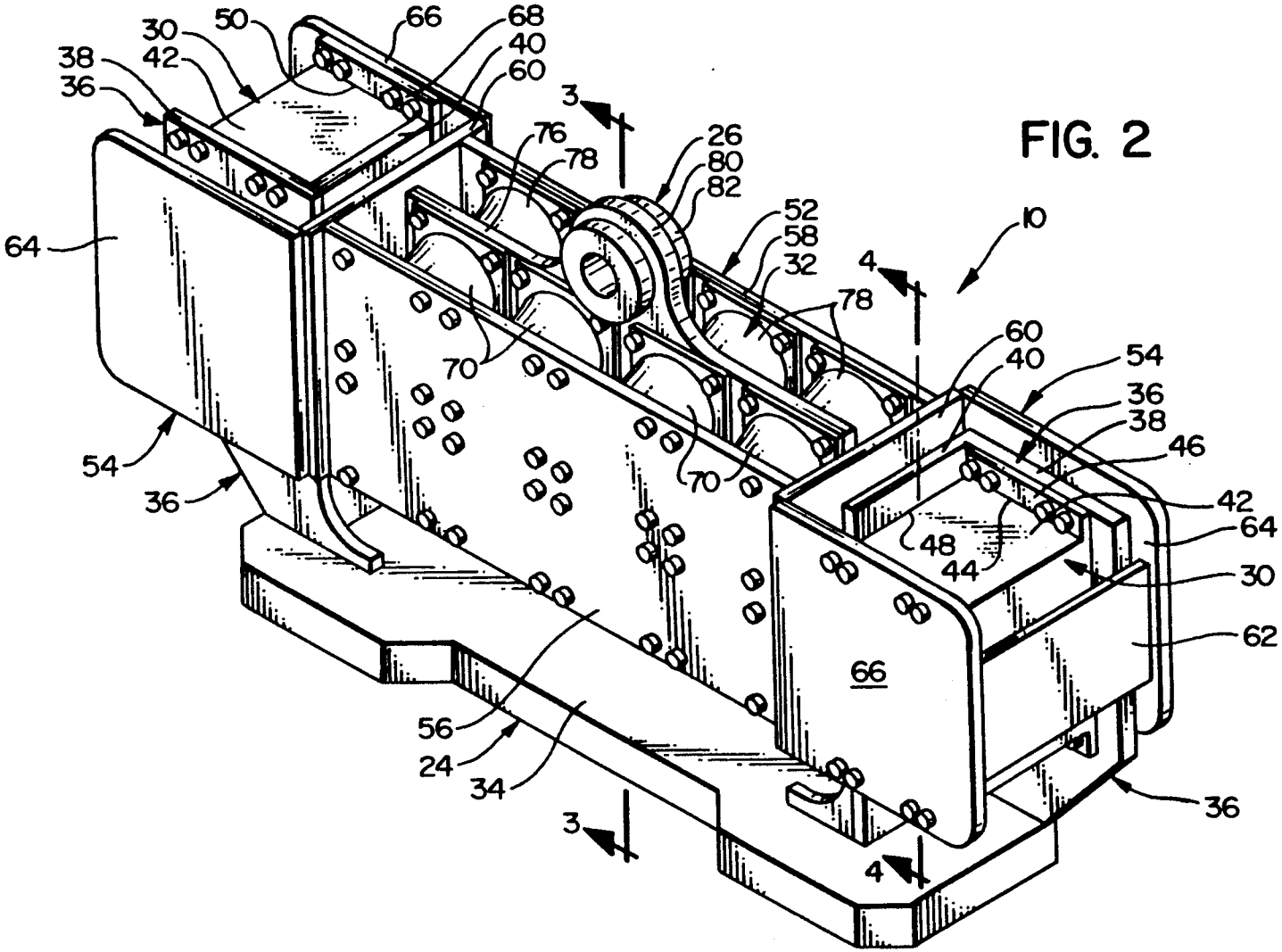
FIG. 2 is an isometric view of the shock absorbing apparatus and first embodiment of the present invention.
Figure 3:
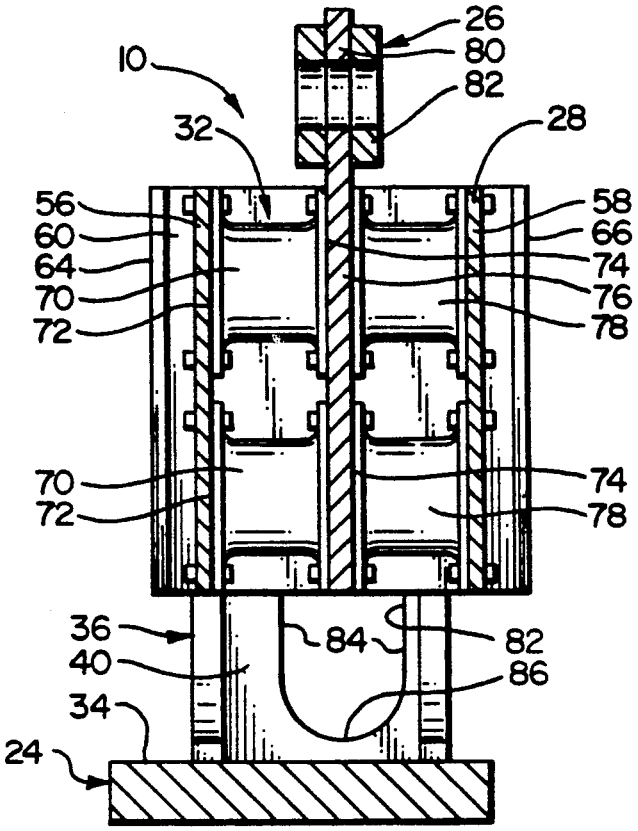
FIG. 3 is a sectional view taken along line 3—3 of FIG. 2.

With reference to FIG. 2, in terms of function, the apparatus 10 can be considered as comprising five main components: namely, (a) a base section 24 by which the apparatus 10 is connected to the vibratory machine 16, (b) a connecting section 26 by which the apparatus 10 is connected to the cable 12 or other connecting device, (c) an intermediate section 28, (d) a first shock absorbing means 30 which is operatively connected between the base section 24 and the intermediate section 28, and (e) a second shock absorbing means 32 operatively connected between the intermediate section 28 and the connecting section 26.

The vibratory forces from the machine 16 are imparted directly into the base section 24. The first shock absorbing means 30 is more yielding and will perform a more significant shock absorbing function under lower load conditions, while the second shock absorbing means 32 is arranged to have the primary function of absorbing the shock loads when the loading is at a substantially higher level. In the following description, the structure of each of the five main components 24–32 will be described in detail, after which there will be a summary of the mode of operation.

The base section 24 comprises a main horizontally disposed base plate 34 which can be attached directly to the vibratory machine 16. Two base shock mounting structures 36 are fixedly attached to the base plate 34 at opposite ends thereof.

For purposes of description, the apparatus 10 will be considered as having a longitudinal axis which extends in a lengthwise direction from one shocking mounting structure 36 to the other, and a transverse axis perpendicular to the longitudinal axis. The vertical axis will be perpendicular to these other two axis. The term "front" will be used to denote that side of the apparatus 10 which appears nearer to the viewer in FIG. 2, while the term "rear" denotes an opposite side or direction. The term "inner" or "inward" will be used to denote a location closer to the vertical center axis of the apparatus 10, while the terms "outer" or "outward" will denote a location further away from that center axis.

Each shock mounting structure 36 comprises a vertically and longitudinally aligned side plate 38 and a vertically and transversely aligned gusset plate 40 fixedly attached thereto. The lower edges of these two plates 38 and 40 are fixedly connected to the upper surface of the base plate 34.

The first shock absorbing means 30 comprises two main first shock absorbers 42, each of which is made of a rubber like shock absorbing material and has the configuration of a large rectangular prism. The term "front" will be used to denote that portion of the apparatus 10 which appears nearer to the viewer in FIG. 2, while the term "rear" denotes an opposite side or direction. The term "inner" or "inward" will be used to denote a location closer to a vertical center axis of the apparatus 10, while the terms "outer" or "outward" will denote a location further away from that center axis.

A rear planar surface of one of the right shock absorbing member 42 (the upper edge of this surface being shown at 44) is fixedly connected to an intermediate plate 46 that is in turn fixedly connected to the right side plate 38. The inner planar surface (the upper edge of which is indicated at 48) of the shock absorbing member 42 is not connected to the gusset plate 40. The second connection of the shock absorber 42 is to the aforementioned intermediate section 28, and this is at the surface (the upper edge of which is indicated at 50 relative to the left-hand shock absorbing member 42) which surface 50 is oppositely disposed to the surface 48.

The aforementioned intermediate section 28 comprises a middle portion 52 and two end portions 54. The middle section 52 comprises front and rear vertically and longitudinally aligned metal plates 56 and 58, respectively, which are fixedly connected by their outer edges to inner plates 60 of the end portions 54.

Each end portion 54 has a box-like configuration, each of which comprises the aforementioned inner wall 60, an outer wall 62, and two side walls 64 and 66. It will be noted that the side wall 64 of the right-hand intermediate section portion 54 is at a rear location while the corresponding wall 64 of the left intermediate section portion 54 is at a front location. In like manner, the wall 66 of the right end portion 54 is at a front location, while the corresponding wall 66 of the left-hand portion 54 is at a rear location.

The surface portion 50 of each of the shock absorbing blocks 42 is fixedly connected to a joining plate 68 which fits against and is fixedly connected to the aforementioned side wall 66. Thus, it becomes apparent that the two shock absorbing blocks or members 42 make a connection between the base section 24 and the intermediate section 28 by means of the surface 44 being fixedly attached to the plates 46 and 38 of the base section 24, while the opposite surface 50 of each of the shock absorbing members 42 is fixedly connected to the plate 68 of the plate 66 of the intermediate section 28.

The aforementioned front and rear intermediate plates 56 and 58 are connected through the second shock absorbing means 32 to the aforementioned connecting section 26. More specifically, there is a front set of eight cylindrical rubber like shock absorbing members 70, with the axis of each cylinder being horizontally aligned along a transverse axis. The front face 72 of each of these cylindrical shock absorbing members 70 is fixedly connected to the front plate 56, while the rear surface 74 of each of these shock absorbing members 70 is fixedly connected to a main center plate 76 which is part of the connecting section 26. As shown herein, these eight forward shock absorbing members 70 are disposed in two horizontal rows, with four upper shock absorbing members 70 being positioned directly above the bottom row of shock absorbing members 70.

In like manner, there is a rear set of eight cylindrical shock absorbing members 78 which extend between the rear intermediate plate 58 and the main center plate 76, with these shock absorbing members 78 being fixedly connected to the plates 58 and 76.

To describe now the connecting section 26, the aforementioned main center plate 76 is vertically and longitudinally aligned, and fixedly connected to its upper edge is a connecting ring 80 having a reinforcing sleeve 82 positioned therein. This connecting ring 80 attaches to the aforementioned cable 12.

From the foregoing description, it is apparent that the base section 24 can move vertically relative to the intermediate section 28, with the first shock absorbing members 42 yieldingly resisting such vertical movement. Further, it is also apparent that the connecting section 26 can move vertically relative to the intermediate section 28 with this vertical movement being yieldingly resisted by the shock absorbing means 32, and more specifically by means of the two sets of shock absorbing members 70 and 78.

Figure 4:
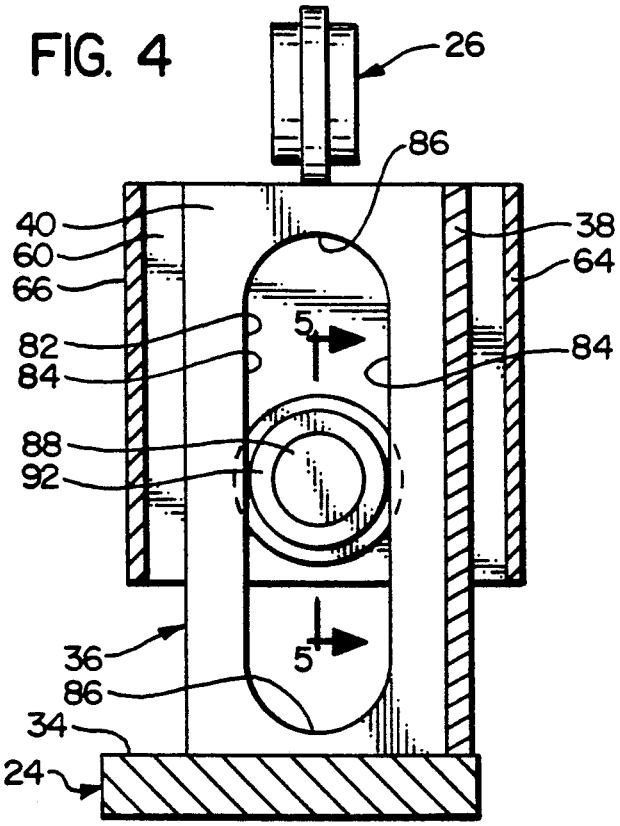
FIG. 4 is a sectional view taken along line 4—4 of FIG. 2.
Figure 5:
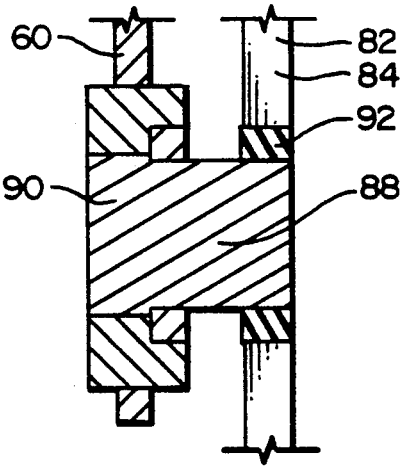
FIG. 5 is a sectional view taken along line 5—5 of FIG. 4.

In order to provide upper and lower limits between the relative vertical motion of the base section 24 and the intermediate section 28, there is provided a limit mechanism which is best illustrated in FIGS. 4 and 5. Each of the aforementioned gusset plates 40 is formed with a vertically aligned slot-like opening 82 having straight vertical side surfaces 84 and upper and lower semicircular end surfaces 86. Each of the plates 60 has fixedly attached thereto a longitudinally and outwardly protruding cylindrical stop member 88 which is mounted by its inner end 90 to its related plate 60 and has at its outer end a mounting ring 92 (desirably made from a hard rubber or other moderately resilient material) that fits within the aforementioned slot 82. It is apparent that relative vertical motion between the base section 24 and the intermediate section 28 will cause a corresponding vertical motion of the stop member 92 relative to the slot 82.

To describe the operation of the present invention, let it be assumed that the shock absorbing apparatus 10 is in its operating position, as shown in FIG. 1, where the cable 12 is attached to the connecting ring 80, and the vibratory machine 16 is fixedly attached to the base plate 34. Let it be assumed that the jaws 18 of the vibratory machine 16 are fixedly secured to the piling 20, and that the cable 12 is under tension so as to pull the piling 20 out of the ground. Let it further be assumed that the force needed to pull the pile 20 out of the ground is relatively small (e.g., about two tons or more).

As mentioned previously, the shock absorbing members 70 and 78 are relatively stiff, and therefore will allow little relative movement between the connecting section 26 and the intermediate section 28 under a moderate load. On the other hand, the two relatively large shock absorbing blocks 42 are more yielding and will permit substantially greater deflection between the base section 24 and the intermediate section 28 for a given vertical load in comparison with the amount of vertical displacement between the connecting section 26 and intermediate section 28 for that same load.

As the tension is placed on the cable 12, the middle main plate 76 will be pulled upwardly, and the entire intermediate section 28 will also be moved vertically with very little relative movement between the main central plate 76 and the front and rear intermediate plates 56 and 58. On the other hand, the entire intermediate section 28 will move upwardly to a much greater extent relative to the base plate 34 which is fixedly secured to the vibratory machine 16. This will cause each of the main shock absorbing blocks 42 to distort so as to assume a general configuration of a parallelogram. At the same time, the two stop members 88 will be moved upwardly in their related slots 82 to some intermediate position. When the machine 16 beings its vibrating motion, the vibrations will be transmitted into the base plate 34 causing relatively rapid up and down vibratory movement of this plate 34. At this time (i.e., under relatively moderate tension loading of the cable 12), there will be very little up and down vibratory movement of the intermediate section 28. Thus, most of the shock absorbing function will be performed by the first more yielding shock absorbing means 30 which comprises the two large shock absorbing blocks 42.

Let it now be assumed that it is the desire to pull a pile 20 out of the ground, and a substantially larger tension force is required to accomplish this task (e.g., up to as high as one hundred tons). Under these circumstances, the tension force on the cable 12 will be sufficiently great so that the two shock absorbing members 42 will distort to the extent that the two stop members 88 will move to the upper limit of the slots 82 so that the bearing ring 92 will bear against the upper semi-circular stop surface 86. Under these circumstances, the up and down vibratory movement of the base plate 34 will be transmitted through the base end sections 36 directly to the intermediate section 28 so that this section 28 moves up and down with substantially the same vibratory motion as the plate 34. Under these circumstances, the shock loads are absorbed primarily in the second shock absorbing means 32 (i.e., the two sets of shock absorbing members 70 and 78). Since these shock absorbing members 70 and 78 are less yielding, these are better adapted to properly absorb these shock loads.

It is apparent that the dynamic characteristics of each of these shock means 30 and 32 must be designed to match the characteristics of the components with which these are to operate, and also to match the expected force loads which are to be encountered. Since this is well within the state of the art, these considerations will not be discussed in detail at this time.

Second Embodiment of the Invention

Figure 6:
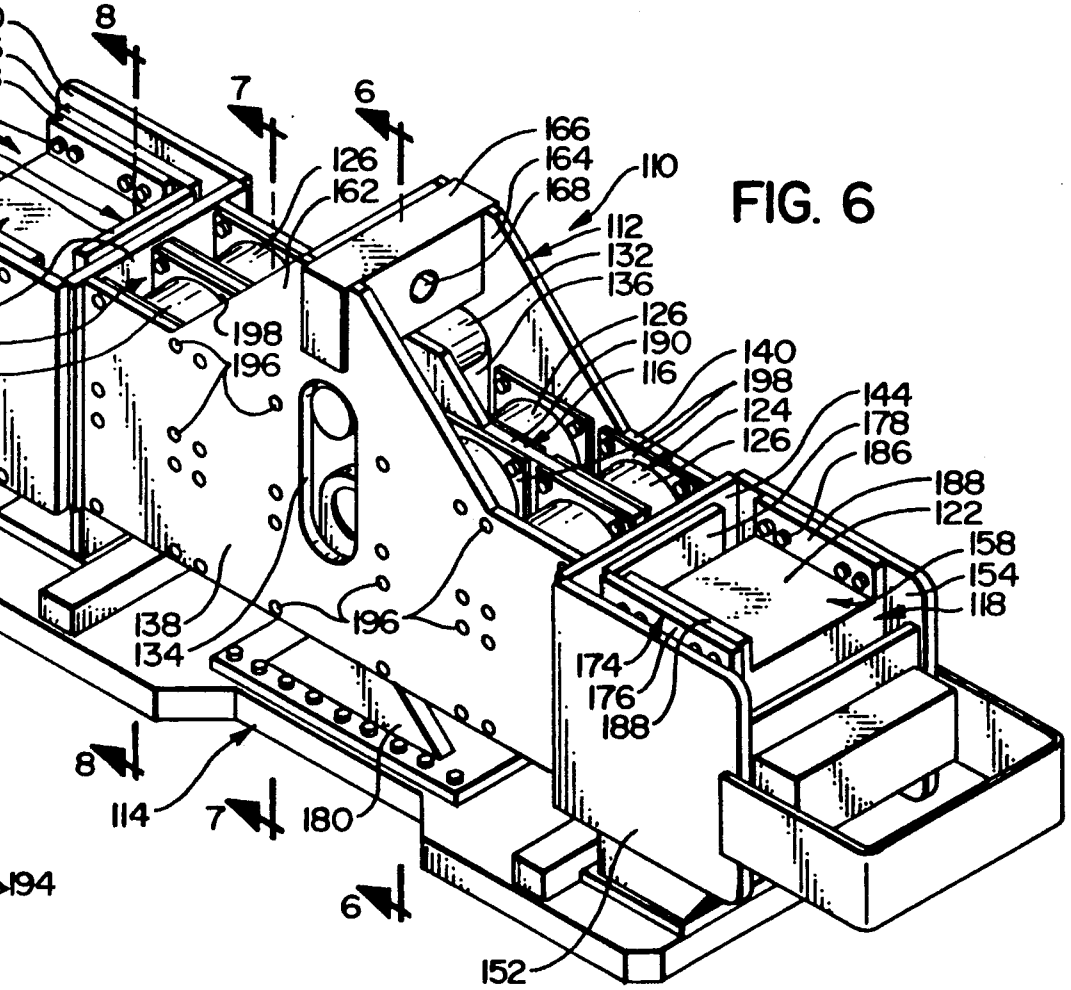
FIG. 6 is an isometric view of the shock absorbing apparatus of a second embodiment of the present invention.

Turning now to FIG. 6, indicated generally at 110 is a shock absorbing apparatus of a second embodiment of the invention. This shock absorbing apparatus 110 is designed to be suspended by the cable 12 from the boom 14 of the crane 15 in a manner similar to the suspension of the shock absorbing apparatus 10 of the first embodiment (FIG. 1). The crane 15 exerts a tension load on the shock absorbing apparatus 110 through the cable 12. The shock absorbing apparatus 110 of the second embodiment is also connected on its bottom side to the vibratory machine 16.

The shock absorbing apparatus 110 basically comprises a connecting section 112, a base section 114, an intermediate section 116, a first set 118 of rectangular solid shock absorbing numbers 120 and 122, and a second set 124 of cylindrical shock absorbing members 126. The first set 118 of shock absorbers is attached between the connecting section 112 and the base section 114 to form a first shock absorbing means for absorbing vibratory forces generated by the vibratory machine 16, while the second set 124 is connected between the connecting section 112 and the intermediate section 116 to form a second shock absorbing means for absorbing these vibratory forces.

Figure 7:
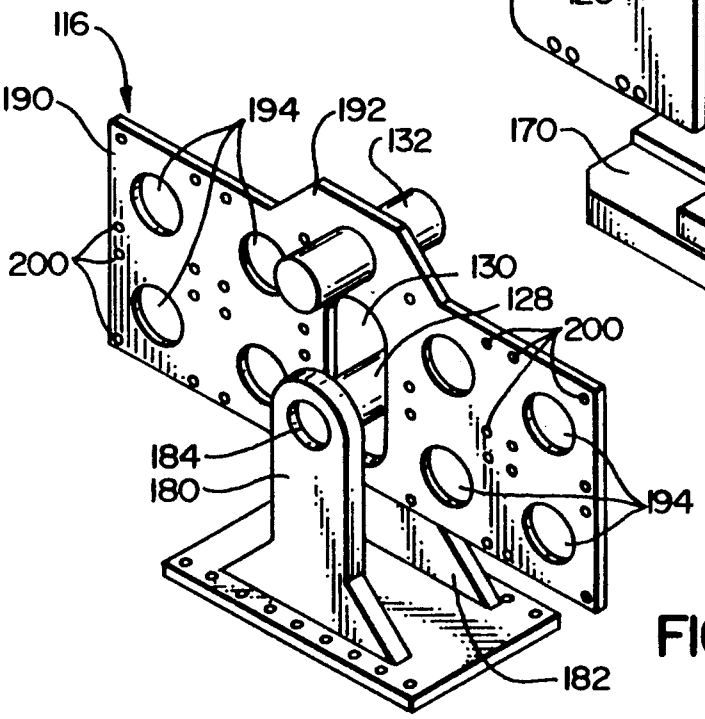
FIG. 7 is an isometric view showing the primary components of the first and second stop means of the second embodiment of the invention.

Secured to the base section 114 is a first stop member 128 (FIG. 7), which extends through a first aperture or slot 130 formed in the intermediate section 116. The first stop member 128 and the first slot 130 comprise a first stop means for limiting relative movement between the base section 114 and the intermediate section 116.

Assembled as described above, the intermediate section 116, the first stop member 128, and the first slot 130 comprise a shock connecting means for distributing the vibratory forces generated by the vibratory machine 16 between the first set 118 of shock absorbers 120 and 122 and the second set 124 of shock absorbers 126. This shock connecting means distributes the shock of the vibratory force primarily to the first set 118 of shock absorbing members 120 and 122 when the tension load applied by the crane 15 is relatively smaller and primarily to the second set 124 of shock absorbing members 126 when the tension load is relatively larger.

A second stop member 132 extends through second and third apertures or slots 134 and 136 formed in the connecting section 112. The second stop chamber 132 and the second and third slots 134 and 136 comprise a second stop means for limiting relative movement between the intermediate section 116 and the base section 114.

In the following discussion, each of the above mentioned components 112–136 will be described in detail, after which the modes of operation of the shock absorbing apparatus 110 will be described.

For purposes of description, the term "front" will be employed to denote the portion of the apparatus 110 that appears nearer to the viewer in FIG. 6. Similarly, the terms "back," "left," "right," "top", and "bottom" denote the portions of the apparatus 110 that appear in the corresponding positions in FIG. 6.

The apparatus 110 will be considered as having a longitudinal axis extending from left to right, a transverse axis extending from front to back, and a vertical axis extending from top to bottom in FIG. 6. These axes extend through the center of the apparatus 110. The terms "inner, inward" and "outer, outward" generally indicate locations closer to and further from, respectively, the center of the apparatus 10.

The above-mentioned connecting section 112 is substantially symmetrical about a plane formed by the transverse and vertical axes. This connecting section 112 basically comprises a front wall 138, a back wall 140, a left wall 142, and a right wall 144, which are all vertically aligned and together define a center cavity 146. The above-mentioned slots 134 and 136 are formed in the center portion of the front and back walls 138 and 140.

Extending outwardly from the left and right walls 142 and 144 are vertically aligned left end walls 148 and 150 and right end walls 152 and 154. The left wall 142 and the left end walls 148 and 150 define a left end cavity 156, while the right wall 144 and the right end walls 152 and 154 define a right end cavity 158.

Braces 162 and 164 extend from the upper edges of front and back walls 138 and 140 above the slots 134 and 136, respectively. A connecting bar 166 is securely attached between the braces 162 and 164. A connecting hole 168 is formed in connecting bar 166. The aforementioned cable 12 attaches to the connecting section 112 via a shackle (not shown) inserted through this connecting hole 168.

The apertures or slots 134 and 136 are formed in the middle portion of the front and back walls 138 and 140 of the connecting section 112. These slots 134 and 136 extend vertically to allow vertical movement and prevent longitudinal movement of the second stop member 132. In the preferred embodiment, the length of these slots 134 and 136 in the vertical direction is approximately 10 inches.

The above-mentioned base section 114 of the apparatus 110 basically comprises a bottom plate 170 and left and right projecting members 172 and 174 designed to extend or protrude vertically from the bottom plate 170 into the left and right cavities 156 and 158 of the connecting section 112. Each projecting member 172 and 174 comprises a longitudinally aligned side plate 176 and a transversely aligned gusset plate 178. In the preferred embodiment, the side plate 176 of the left projecting member 172 is to the rear side of the left cavity 156, while the side plate 176 of the right projecting member 174 is to the front side of the right cavity 158. The bottom plate 170 has holes formed therein so that the vibrating machine 16 may be securely bolted thereto.

The base section 114 also comprises two support brackets 180 and 182 (FIG. 7) which vertically and longitudinally extend from the upper side of the bottom plate 170. The ends of the above-mentioned first stop member 128 are mounted in holes 184 (only one shown in the drawing) formed in the upper ends of the support brackets 180 and 182. The first stop member thus supported is parallel to the transverse axis and is maintained a fixed distance from the bottom plate 170.

The aforementioned shock absorbing members 120 and 122 are solid rubber-like blocks in the shape of a rectangular solid. These shock absorbing members absorb shock by yieldingly resisting vertical movement of the base section 114 relative to the connecting section 110. The combined shock absorbing capacity of these shock absorbing members (120 and 122 is generally in the range of 0.25 and 1.0 tons, and is preferably 0.5 tons, per inch of distortion. In other words, in the second preferred embodiment as described in more detail below, 0.5 tons of load must be applied between the base section 114 and the connecting section 1112 to cause one inch of relative displacement therebetween.

These members 120 and 122 are operatively connected between the connecting section 112 and the base section 114 in the following configuration. The front side of the shock absorbing member 120 is securely attached to the inner surface of the end wall 148 extending from the left wall 142. The back side of the shock absorbing member 120 is securely attached to the side wall 176 of the left projecting member 172. Similarly, the front side of the shock absorbing member 122 is securely attached to the inner surface of the end wall 154 extending from the right wall 144, and the back side of the shock absorbing member 122 is securely attached to the side wall 176 of the right projecting member 174. Thus, the connection of the shock absorbing members 120 and 122 to the connecting and base sections 112 and 114 is essentially a mirror image about the plane defined by the transverse and vertical axes.

The shock absorbing members 120 and 122 are operatively connected between the base section 112 and the connecting section 116 by bolts 186 that extend through flanges 188 on the members 120 and 122 and into end walls 148 and 154, respectively.

The above-introduced intermediate section 116 will now be discussed in further detail. The intermediate section 116 is substantially symmetrical about the plane formed by the transverse and vertical axes and comprises a generally rectangular plate 190 that has a stop projection 192 extending from the upper edge thereof. An array of four holes 194 are formed on each of the left and right halves of the plate 190. These holes 194 reduce the overall weight of the intermediate section 116 and are coaxially aligned with the cylindrical shock absorbing members 126.

The above-mentioned first slot 130 is formed in the center portion of the plate 190. This slot 130 extends vertically from near the bottom edge of the plate 190 to just below the stop projection 192. This slot 130 allows vertical movement and prevents longitudinal movement of the first stop member 132. The length of this slot 130 in the vertical direction is approximately 12 inches in the preferred embodiment.

The second stop member 132, which is a cylindrical piece of metal, is mounted in the stop projection 192 so that it is parallel to the transverse axis. When the apparatus 110 is assembled, the stop member 132 extends a short distance from the front and back sides of the plate 190. The front end of the stop member 132 extends into the second slot 134, while the back end thereof extends into the third slot 136 (FIG. 6).

The above-mentioned second set 124 of shock absorbers is operatively connected between the intermediate section 116 and the connecting section 112 so that they are generally parallel to the transverse axis. Specifically, bolts 196 are inserted through holes in flanges 198 formed on the ends of each cylindrical shock absorbing members 126. These bolts 196 are adapted to be secured in holes in the front and back walls 138 and 140 of the carrying section 112 and in holes 200 in the plate 190. In the second preferred embodiment, a total of sixteen cylindrical shock absorbing members 126 are employed: eight between the front wall 138 and front side of the plate 190, and eight between back wall 140 and the back side of the plate 190.

These shock absorbing members 126 are made of a rubber-like shock absorbing material formed in a generally cylindrical shape. These members 126 absorb shock by yieldingly resisting vertical movement of the intermediate section 116 relative to the connecting section 112. The maximum total shock absorbing capacity of these sixteen shock absorbing members 126 is approximately between 6 and 10 tons, is preferably 8 tons, per inch of distortion. In other words, 8 tons of force would be necessary to displace the connecting section 112 one inch relative to the intermediate section 114.

The total shock absorbing capacity of the shock absorbers 126 is significantly greater than the total shock absorbing capacity of the shock absorbing members 120 and 122 of the first set 118 of shock absorbing members; that is, the relatively large block like shock absorbing members 120 and 122 permit substantially greater deflection per unit force than so the cylindrical shock absorbing members 126. Therefore, in the second preferred embodiment, the second set 124 of shock absorbers absorbs approximately 16 times the shock as the first set 118 of shock absorbers.

From the foregoing description, it is apparent that, when the various components 112–136 are assembled and the apparatus 110 is operating, the connecting, intermediate, and base sections 112, 114, 116 can move vertically relative to each other. Generally, movement of the base section 114 relative to the connecting section 112 is damped by the first set 118 of shock absorbing members and limited by the interaction of the first stop member 128 and slot 130. Similarly, movement of the intermediate section 114 relative to the connecting section 112 is damped by the second set 124 of shock absorbing members and limited by the interaction of the second stop member 132 and the second and third slots 134 and 136.

The modes of operation of the present invention will now be described. In general, the present invention can be employed when driving a pile or when pulling the pile. When driving a pile, the weight of the various pieces of machinery and the vibratory force generated by the vibratory machine 16 cooperate to force the pile into the ground.

When pulling a pile, a tension load is applied to the apparatus 110 by the crane 15 in cooperation with the vibratory force to pull the pile from the ground. The amount of tension load required to pull any given pile from the ground varies according to various conditions, such as the type of pile, depth of the pile, and type of soil into which the pile was driven, and generally is not known exactly prior to the pulling of the pile. Accordingly, the tension load is gradually increased until the pile breaks loose from the ground. After the pile breaks loose, an operator of the crane attempts to apply a steady tension load on the pile to pull the pile completely from the ground.

The second embodiment of the present invention is designed such that the apparatus 110 goes through two modes of operation when the tension load is gradually increased to pull the pile from the ground. The modes of operation of the second embodiment will be described below for both pile driving and pile pulling in further detail with reference to FIGS. 8–13.

When the vibratory machine 16 is employed to drive the pile 20, little or no tension load is applied by the crane 14 to the apparatus 110. In this case, the weight of the shock absorbing apparatus 110, vibratory machine 16, and jaw mechanism 18 is applied to the pile 20 while the vibratory machine 20 is operating. The combination of the weight and vibration applied to the pile 20 forces the pile 20 into the ground.

Figure 8C:
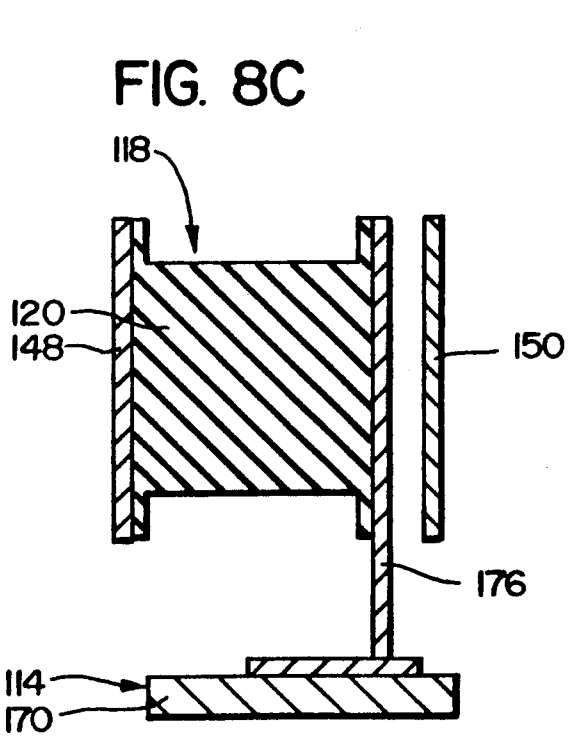
FIGS. 8C, 9C, 10C, 11C, and 12C are sectional views taken along, lines 8—8 of FIG. 6.
Figure 8B:
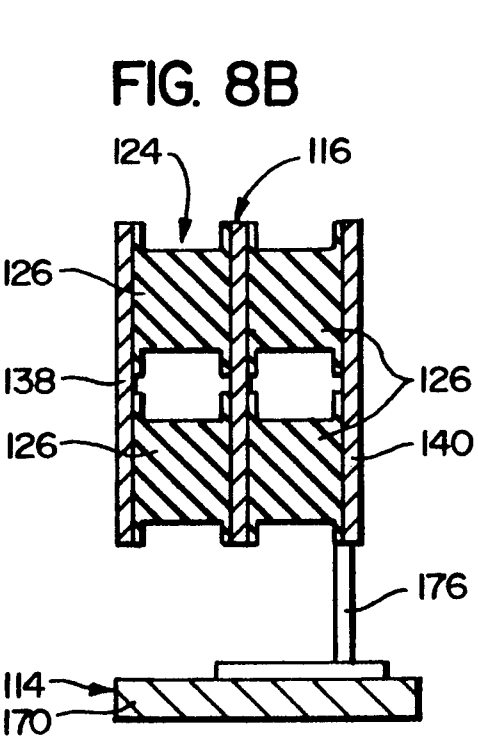
FIGS. 8B, 9B, 10B, 11B, and 12B are sectional views taken along lines 7—7 of FIG. 6.
Figure 8A:
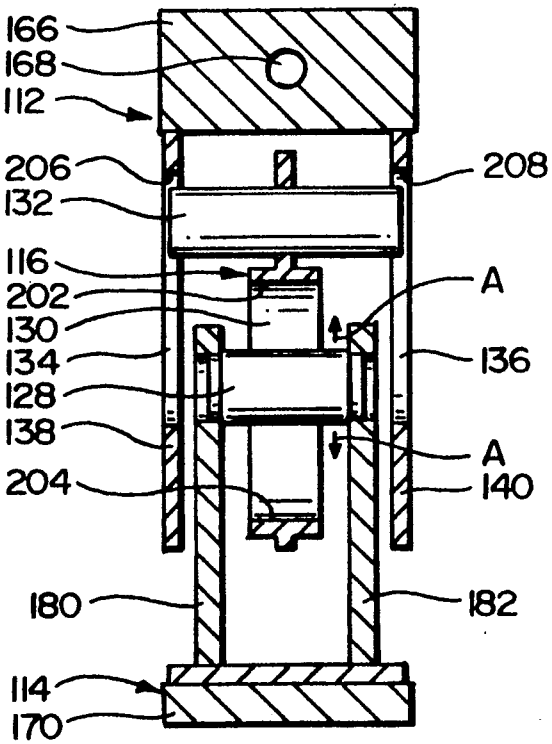
FIGS. 8A, 9A, and 10A, 11A and 12A are sectional views taken along lines 6—6 of FIG. 6.

FIG. 8A depicts the relative positions of the connecting section 112, intermediate section 114, and base section 116 when no tension loads are applied to the shock absorbing apparatus 110 by the crane 15 through the cable 12. FIG. 8A further depicts the relative displacement of the first stop member 128 within the slot 130 and the second stop member 132 within the second and third slots 134 and 136. When no external loads are applied to the apparatus 110, the first stop member 128 resides approximately midway between the upper and lower surfaces 202 and 204 of the slot 130, while the second stop member 132 extends into the slots 134 and 136 towards the upper edges 206 and 208 thereof FIGS. 8B and 8C depict the state of the second set 124 of shock absorbing members 126 and the left shock absorbing member 120 of the first set 118 of shock absorbing members, respectively, when no load is applied to the apparatus 110. In this condition, the shock absorbing members 120, 122, and 126 are not physically distorted.

During the driving of the pile, the vibratory machine 16 applies a vibratory force to drive the pile 20 into the ground as described above. This vibratory force causes the base section 116 to be displaced up and down relative to the connecting section 112. In the second preferred embodiment, this displacement is approximately 15/16 of an inch and is indicated by arrows A in FIG. 8A.

Because the shock absorbing members 120 and 122 are operatively connected between the base and connecting sections, these shock absorbing members 120 and 122 will distort slightly during driving of the pile. Accordingly, when the second preferred embodiment is employed to drive a pile, the shock absorbing members 120 and 122 yieldingly resist the vibratory force to prevent this force from being transferred to the cable 12.

The shock absorbing members 126 are not deformed by the vibratory forces when no tension loads are applied and thus do not absorb the shocks created by the vibratory machine 16 (FIG. 8B).

Figure 9C:
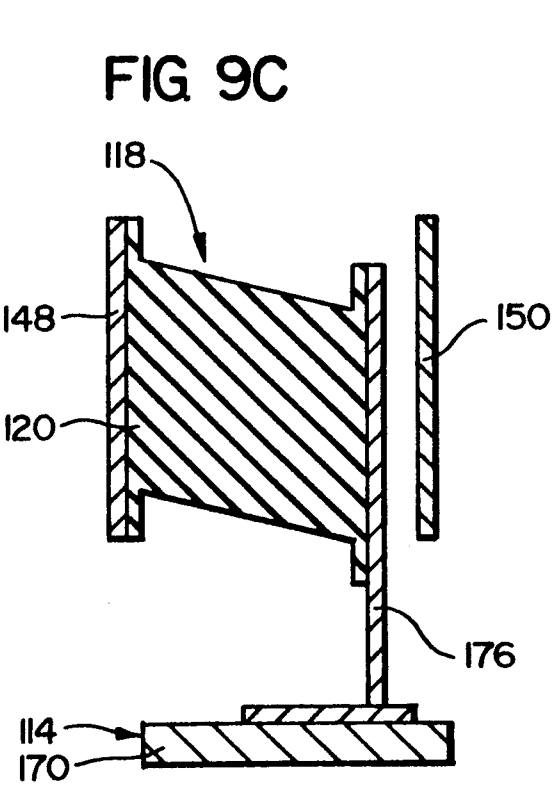
Figure 9B:
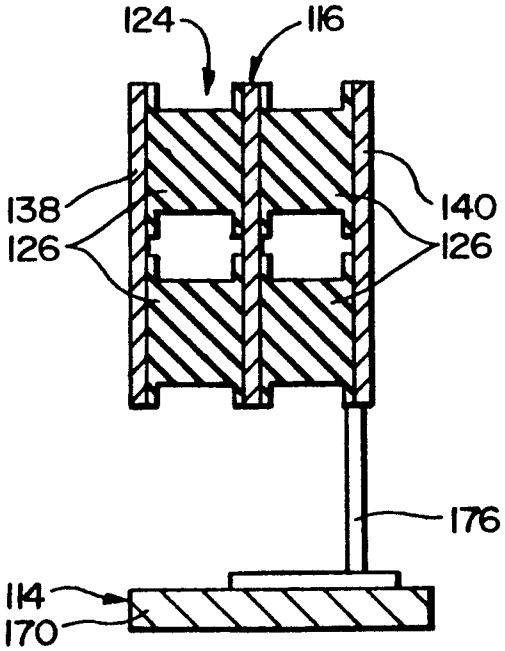
Figure 9A:
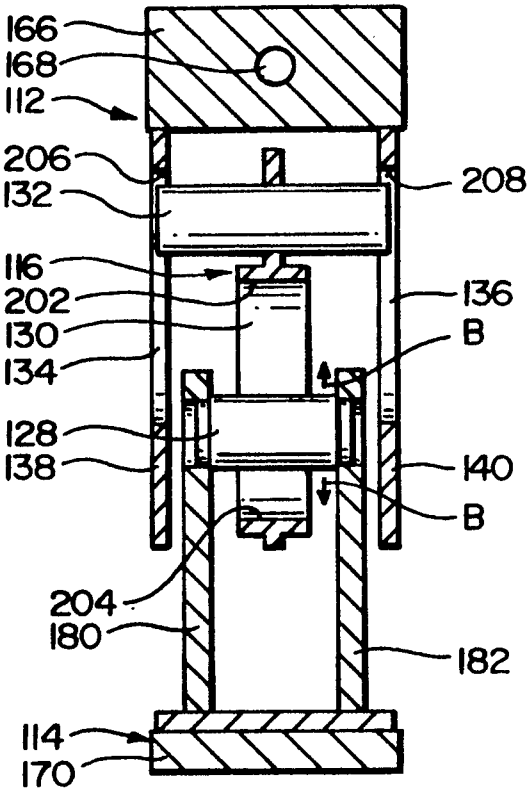

In FIG. 9A, a situation in which the vibratory machine 16 and crane 15 are being employed to pull the pile 20 from the ground is depicted. In this situation, the apparatus 110 is in a first stage mode in which a first, relatively lower range of tension loads are applied by the crane 15. This first stage mode typically occurs for tension loads of less than 10 tons.

In this first range of loads, the vibratory force and tension load cause a displacement of the base section 116 relative to the connecting section 114 (FIG. 9A). As a comparison of FIGS. 8A and 9A reveals, the first stop member 128 is located within slot 130 farther from the top edge 202 and nearer to the bottom edge 204 of the slot 130 than when no tension loads are applied. Arrows B indicate the slight up and down movement caused by the vibratory force. The relative displacement caused by the vibratory forces in this first stage mode is approximately ½ inch.

The shock members 120 and 122, which are operatively connected between the base and connecting sections, distort and yieldingly resist movement caused by the vibratory force (FIG. 9C). Thus, in the relatively lower range of loads, the vibratory forces are absorbed primarily by the first set 118 of shock absorbing members.

As when no tension load is applied by the crane 15, the shock absorbing members 126 are not deformed when the tension loads are within this first relatively smaller range of loads and thus do not absorb the shocks created by the vibratory machine 16 (FIG. 9B).

Figures 10A, 10B, 10C:
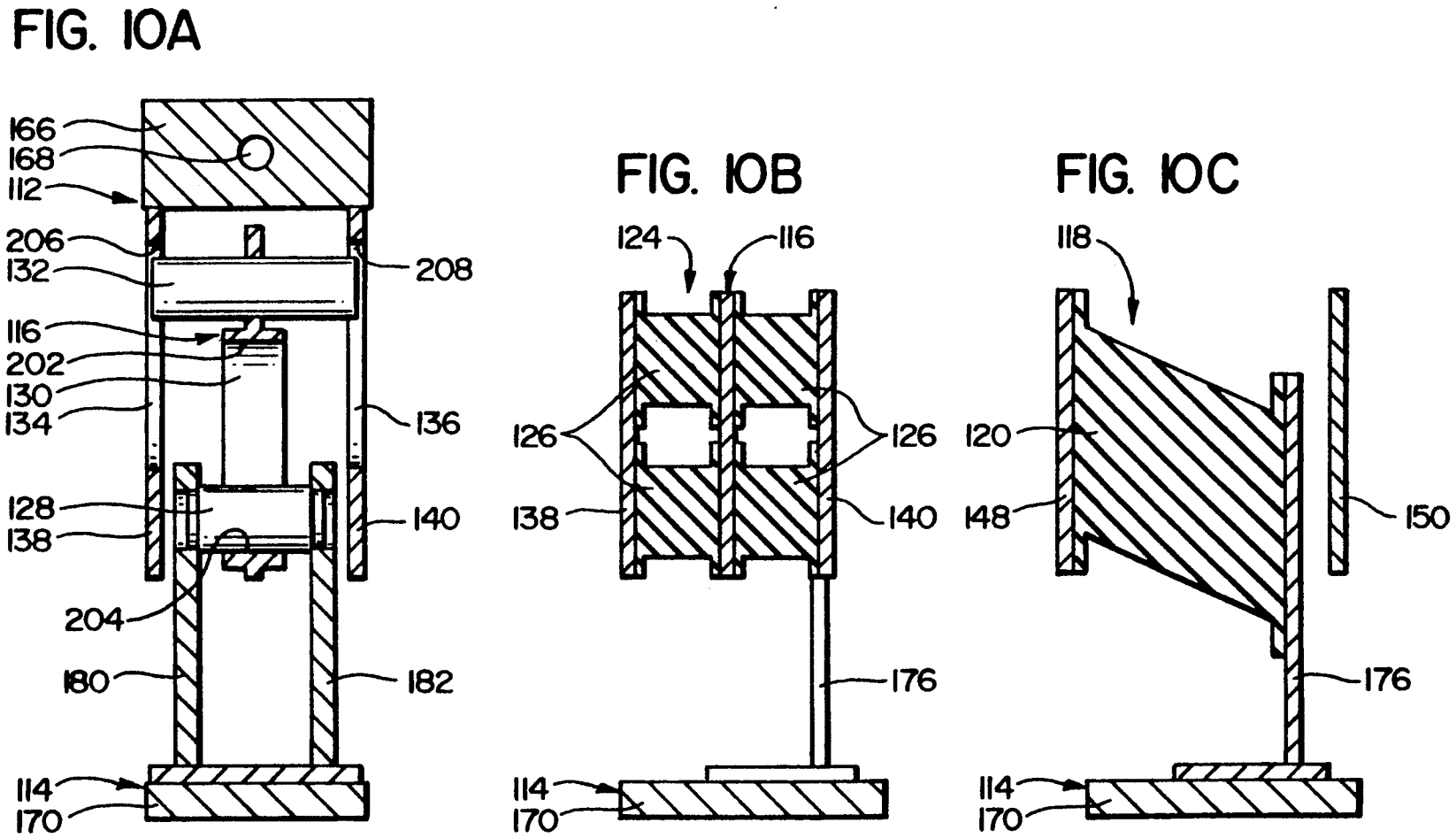

In FIG. 10A, the situation in which a first predetermined vertical tension load is applied to the apparatus 110 is illustrated. This first predetermined load is the maximum load of the first, relatively lower range of loads that may be expected to be applied to the apparatus 110. When the load is equal to or greater than the first predetermined load, the first stop member 128 so contacts the upper edge 204 of the first slot 130 that the base and intermediate sections 116 and 114 come into substantially rigid contact with each other. Accordingly, vibratory forces applied to the base section 116 are transmitted through the first stop member 128 to the intermediate section 114 at loads greater than the first predetermined load.

As can be seen in FIG. 10B, when the loads are at this first predetermined load, the second set 124 of shock absorbing members is not distorted by loads applied to the apparatus 110.

Figure 11C:
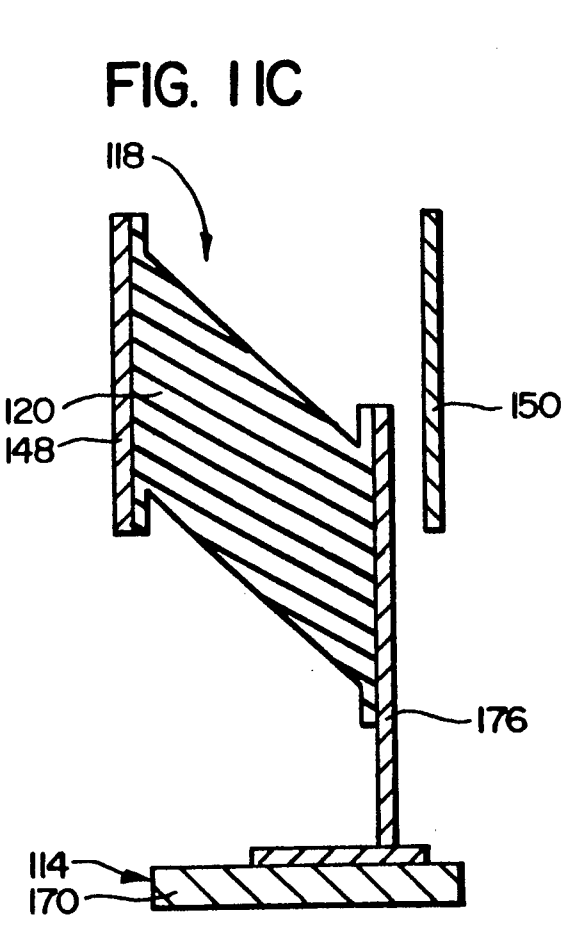
Figure 11B:
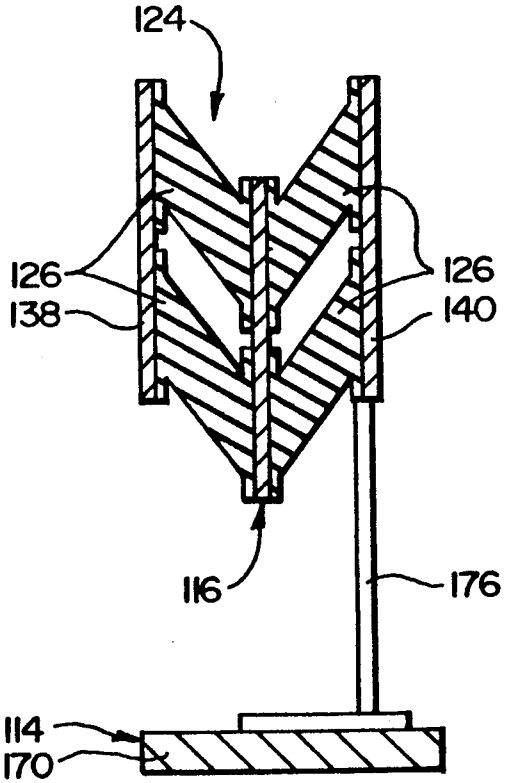
Figure 11A:
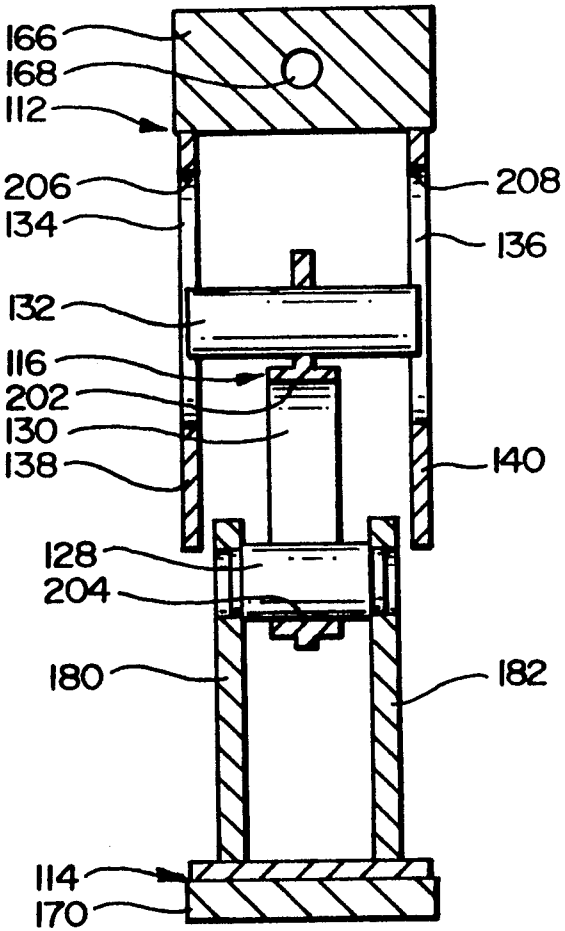

In FIG. 11A, the situation is depicted in which the tension load is within the second, relatively higher range of loads. The apparatus operates in the second stage mode of operation when the loads are within this second range. This second range of loads is approximately between 10 and 100 tons for the preferred embodiment.

As the tension load applied by the crane 15 enters the second, relatively higher range of loads, the first stop member 128 is in substantially rigid contact with the bottom edge 204 of the first slot 130 (FIG. 11A). Therefore, further increase of the tension loads causes a relative displacement of the connecting section 112 relative to the intermediate section 114.

More particularly, during pulling of the pile 20 in this second, relatively greater range, the tension loads and the vibratory force are applied to the pile 20. The vibratory force causes a relative up and down displacement between the base section 116 (as well as the intermediate section 114 which is in rigid contact with the base section 116) and the connecting section 112. This up and down movement is indicated by arrows C in FIG. 11A and is less than 0.5 inches in the preferred embodiment.

Because the second set 124 of shock absorbing members 126 is operatively connected between the intermediate and connecting sections 114 and 112, the shock absorbing members 126 begin to deform when the loads are in the second range of loads (FIG. 11B). As shown in FIG. 11C, the first set 118 of shock absorbing members continues to deform above the first predetermined load.

Therefore, both the first set 118 and second set 124 of shock absorbing members yieldingly resist the vibratory forces generated by the vibratory machine 16 when the apparatus 110 is in the second stage mode. However, as the shock absorbing capacity of the second set 124 of shock absorbing members is significantly greater than that of the first set 118 of shock absorbing members, the vibratory forces are absorbed primarily by the second set 124 of shock absorbing members.

Figures 12A, 12B, 12C:
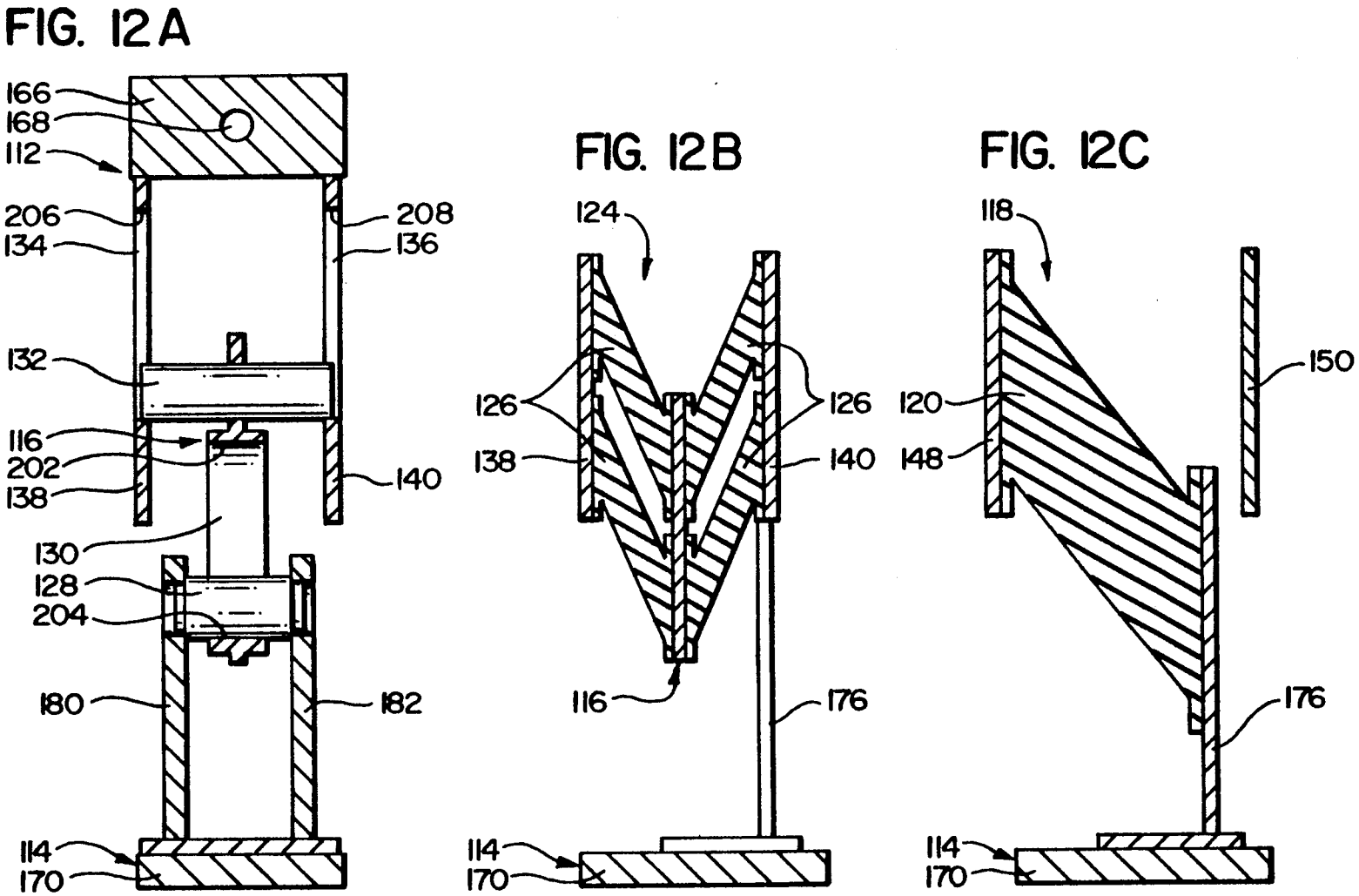

In FIG. 12A, the situation in which a second predetermined vertical tension load is applied to the apparatus 110 is depicted. This second predetermined load, which is greater than the first predetermined load, is the maximum load of the second, relatively higher range of loads.

When the magnitude of the load applied to the apparatus 110 is equal to this second predetermined load, the second stop member 132 so contacts the bottom edges 210 and 212 of the second and third slots 134 and 136 that the intermediate and connecting sections 116 sections 116 and 112 come into essentially rigid contact with each other (FIG. 12A). Essentially then, the vibratory force is transmitted undamped from the vibrating machine 16 to the cable 12 through the base section 116, the intermediate section 114, and the connecting section 112. The vibratory machine 16 thus should not be operated at tension loads exceeding this second predetermined load.

The first and second stop members 128 and 132 serve a purpose in addition to that of limiting relative movement of the components to which they are attached. These stop members 128 and 132 would contact the bottoms of the slots into or through which they extend, as shown in FIG. 12A, if both the first and second sets 118 and 124 of shock absorbing members should fail. Thus, these stop members 128 and 132 prevent the vibrating machine 16 and pile 20 from falling due to a failure of the shock absorbing members.

The dynamic characteristics of each of the sets 118 and 124 of shock absorbing members are designed to match the characteristics of the components to which they are to be attached and the expected force loads to be encountered. Such design has not been discussed in detail herein because it is well within the state of the art.

Third Embodiment of the Invention

Figure 13:
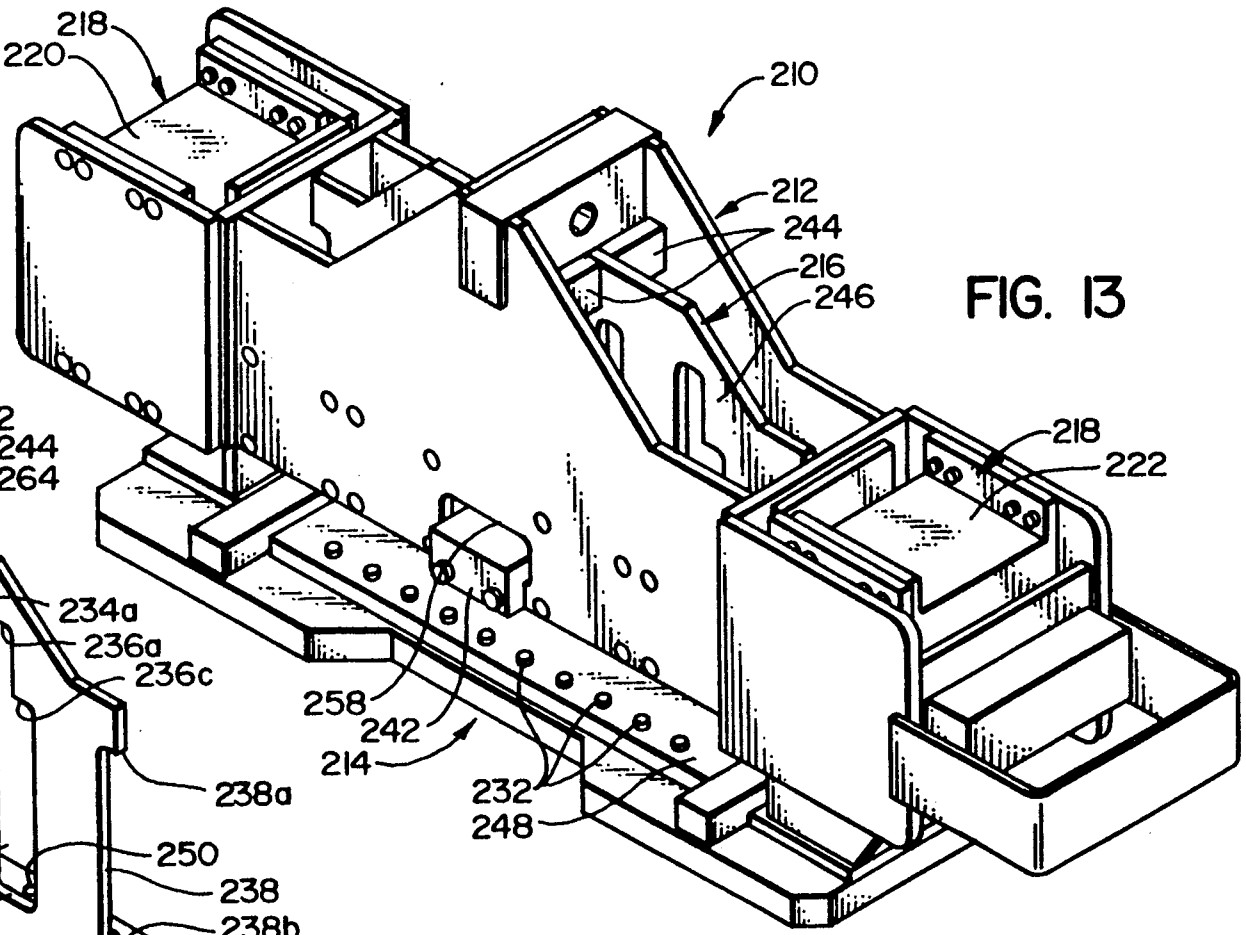
FIG. 13 is an isometric view of a third embodiment of the present invention.

Turning now to FIG. 13, indicated generally at 210 is a shock absorbing apparatus of a third embodiment of the invention. This shock absorbing apparatus 210 is designed to be suspended by the cable 12 from the boom 14 of the crane 15 in a manner similar to the suspension of the shock absorbing apparatus 10 of the first embodiment (FIG. 1). The crane 15 exerts a tension load on the shock absorbing apparatus 210 through the cable 12. The shock absorbing apparatus 210 of the second embodiment is also connected on its bottom side to the vibratory machine 16.

The shock absorbing apparatus 210 basically comprises a connecting section 212, a base section 214, an intermediate section 216, a first set 218 of rectangular solid shock absorbing members 220 and 222, a second set 224 of cylindrical shock absorbing members 226, and a third set 228 of cylindrical shock absorbing members 230. Each of these shock absorbing means is adapted to absorb shock in a predetermined range of tension loads by yieldingly resisting the vibratory force generated by the vibratory machine 16.

The apparatus 210 operates in a manner basically similar to that of the apparatus 110 of the second embodiment. The primary differences between the first and second embodiments are as follows. First, the first set 218 of shock absorbers is attached between the connecting section 212 and the base section 214 to form a first shock absorbing means for absorbing vibratory forces generated by the vibratory machine 16. However, the second embodiment comprises second and third sets 224 and 228 of shock absorbing members, and the second and third sets 224 and 228 are selectively connected between the connecting section 212 and the intermediate section 216 to form second and third shock absorbing means for absorbing these vibratory forces.

Second, unlike in the second embodiment, in the third embodiment the intermediate section 216 is securely attached to the base section 214 by bolts 232.

Figure 14:
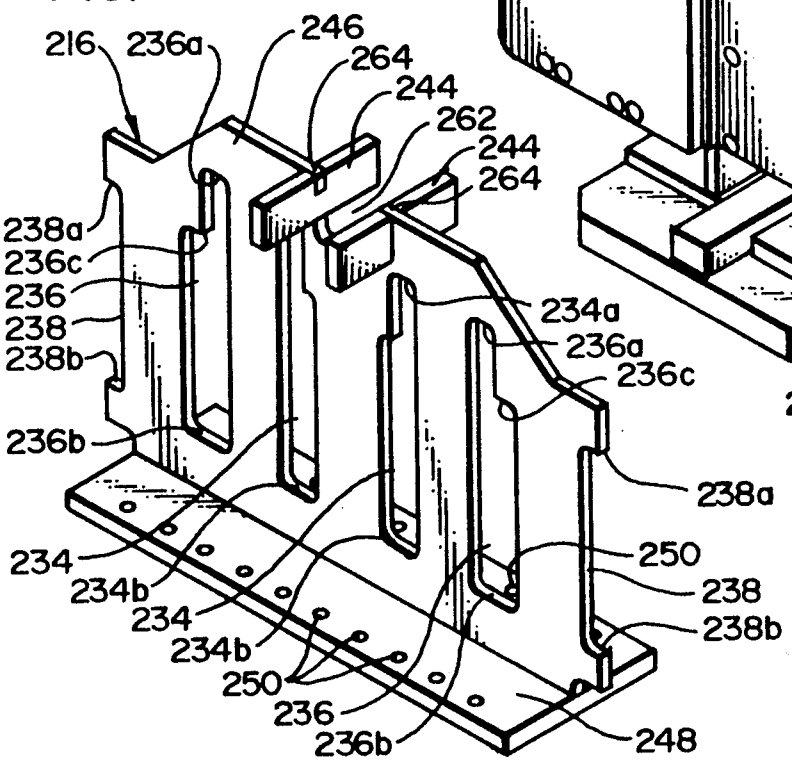
FIG. 14 is an isometric view of the intermediate section of the third embodiment of the present invention.

Third, in the third embodiment, center slots 234, side slots 236, and edge slots 238 are formed in the intermediate section 216 (FIG. 14). Further, the cylindrical shock absorbing members 226 and 230 are not connected directly to the intermediate member, but are instead connected to each other through these slots 234, 236, and 238. The slots 234, 236, and 238 in the intermediate section 216 interact with the second and third sets 224 and 228 of shock absorbing members to comprise a shock connecting means for so distributing the vibratory force among the first, second, and third sets of shock absorbing members that, when the load applied to the cable or carrying member 12 is within any of the predetermined ranges of tension loads, the vibratory force is resisted primarily by shock absorbing means adapted to absorb shock in that predetermined range.

Figure 24:
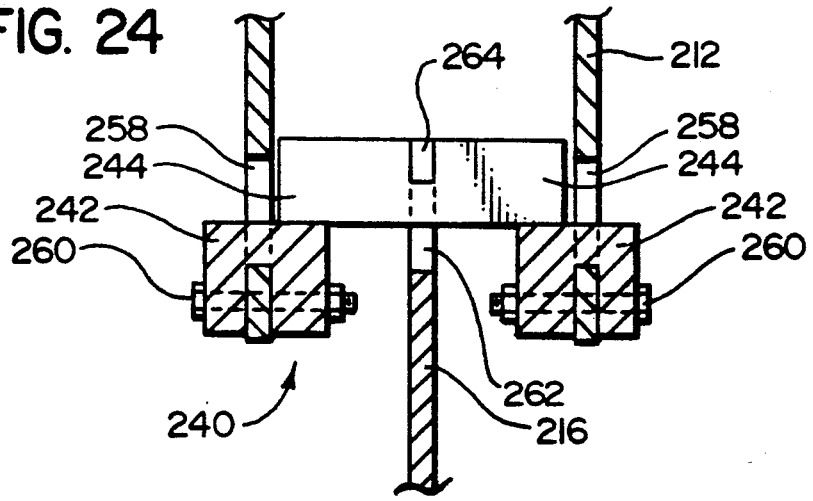
FIG. 24 is a view taken along lines 24 of FIG. 21.

The apparatus 210 further comprises a stop means 240 which is comprised of a pair of stop plates 242 and a pair of stop bars 244 (FIGS. 13, 24). At a certain predetermined tension load, the stop bars so contact the stop plates 242 that the intermediate section comes into essentially rigid contact with the connecting section 212.

The connecting section 212, base section 214, and first set 218 of shock absorbing members are formed and assembled in substantially the same manner as the connecting section 112, base section 214, and first set 118 of shock absorbing means of the apparatus 110 of the second embodiment. Accordingly, in the following discussion, only the fabrication and assembly of the intermediate section 216, second and third sets 224 and 228 of shock absorbing members, and stop means 240 will be discussed in detail. After that, the modes of operation of the apparatus 210 of the third embodiment will be discussed.

For purposes of description, the term "front" will be employed to denote the portion of the apparatus 210 that appears nearer to the viewer in FIG. 13. Similarly, the terms "back," "left," "right," "top", and "bottom" denote the portions of the apparatus 210 that appear in the corresponding positions in FIG. 13.

The intermediate section 216 comprises a vertically aligned slotted plate 246 and a horizontally aligned mounting plate 248. The slotted plate 246 is securely welded to or integrally formed with the mounting plate 248. Holes 250 are formed along the front and back edges of the mounting plate 248 through which the bolts 232 are inserted to attach the mounting plate 248 in a centered position on the base section 214. So attached, the slotted plate 246 is fixed relative to the base section 214.

The intermediate section is symmetrical about its vertical axis. The slots 234, 236, and 238 are vertically aligned. The center slots 234 each have an upper edge **234*a* and a lower edge 234*b*. The side slots 236 each have an upper edge 236*a*, a lower edge 236*b*, and an intermediate edge 236*c*. The edge slots 238 each have an upper edge 238*a* and a lower edge 238*b*. The lower edges 234*b*, 236*b*, and 238*b* are aligned in a first horizontal plane. The upper edges 234*a* and 236*a* of the center and side slots 234 and 236 are aligned in a second horizontal plane. Further, the upper edges 238*a* of the edge slots 238 are aligned with the intermediate edges 236*c* of the side slots 236** in a third horizontal plane. The first horizontal plane is below the second horizontal plane, and the third horizontal plane is between the first and second horizontal planes.

The left and right stop bars 244 are mounted on the intermediate section 216 such that they extend to the front and back of the slotted plate 246.

In the third embodiment, the cylindrical shock absorbing members are not connected between the connecting section and intermediate section; rather, an outer end of each of these members is connected to the connecting section 212 and an inner end of each of these members is connected to the inner end of an opposing member through the various slots formed in the slotted plate 246. The connection of the outer ends to the connecting section 212 is described in the discussion of the second embodiment and will not be described below.

Figure 15:
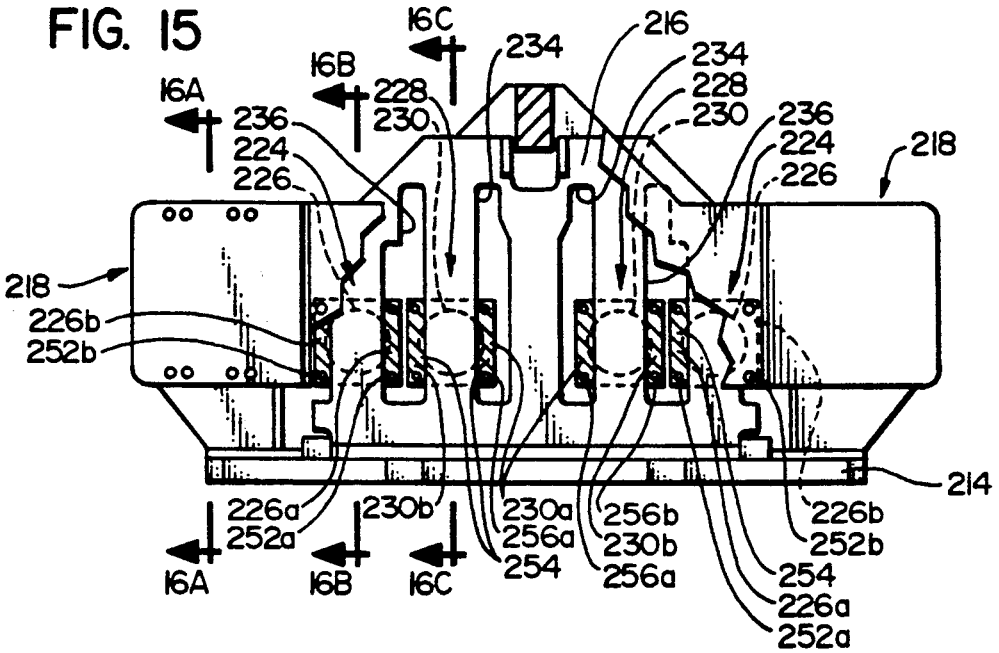
FIG. 15 is a front view of the third embodiment of the present invention.
Figure 23:
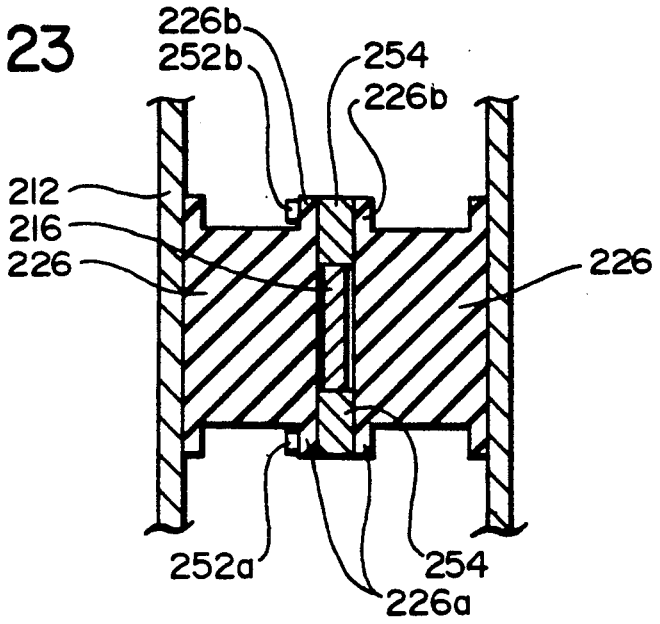
FIG. 23 is a view taken along lines 23 of FIG. 16B.

More particularly, as shown in FIGS. 15 and 23, upper and lower bolts **252*a* extend through holes in inner flanges 226*a* formed on the front cylindrical shock absorbing members 226, through spacers 254 in the side slots 236, and through holes formed on the inner flanges 226*a* of the rear members 226 which oppose the front members 226. Upper and lower bolts 252*b* extend through holes in the outer flanges 226*b* of the members 226, through the spacers 254 in the edge slots 238, and through holes formed on the outer flanges 226*b* of the opposing rear members 226**.

So assembled, the front and rear shock absorbing members 226, the bolts **252*a*,*b*, and the spacers 254 form a shock absorbing unit which is connected between the inner surfaces of the front and back walls of the connecting section 212**.

Similarly, as shown in FIG. 15, upper and lower bolts **256*a* extend through holes in inner flanges 230*a* formed on the front cylindrical shock absorbing members 230, through a spacer (not shown) in the center slots 234, and through holes formed on the inner flanges 230*a* of the rear members 230 which oppose the front members 230. Similarly, upper and lower bolts 256***b* extend through holes in the outer flanges 230*b* of the members 230, through spacers (not shown) in the side slots 236, and through holes formed on the outer flanges 230*b* of the opposing rear members 230. The spacers through which bolts 256*a,b* extend are basically the same as those through which bolts 252*a,b* extend.

So assembled, the front and rear shock absorbing members 230, the bolts 256*a,b*, and the spacers associated with the bolts 256*a,b* form a shock absorbing unit which is connected between the inner surfaces of the front and back walls of the connecting section 212.

Assembled as described above, the intermediate section 216 having slots 234, 236, and 238 through which the shock absorbing units of the second and third shock absorbing means 224 and 228 extend comprises a shock connecting means for so selectively connecting each of the plurality of shock absorbing means between the vibratory device 16 and the cable 12 that the total shock absorbing capacity of the apparatus 210 is incrementally increased as the tension load applied to the carrying member increases.

Turning now to FIG. 24, the stop means 240 will be explained. The stop plates 242 are basically U-shaped in cross-section. These stop plates extend through holes 258 formed in the front and back walls of the connecting section 212. Bolts 260 extend through holes in the stop plate 242 and connecting section 212 to secure the stop plate 242 to the connecting section 212. Thus assembled, a downward force on the stop plate 242 is transmitted to the connecting section 212.

Each stop bar 244 is a rectangular solid bar with a groove cut on its upper surface. A cut-out portion 262 is formed on the upper edge of the slotted plate 246 (FIG. 14). Projections 264 extend into this cut-out portion. These projections 264 are adapted to be snugly received within the grooves on the upper surface of the stop bar so that an upward force applied to the stop bars 244 is transmitted to the slotted plate 246.

The stop plates 242 extend from the connecting section 212 and the stop bars 244 extend from the intermediate section 216 so that the stop bars 244 contact the stop plates 242 when the intermediate section 216 is displaced a predetermined distance relative to the connecting section 212.

Figure 16A:
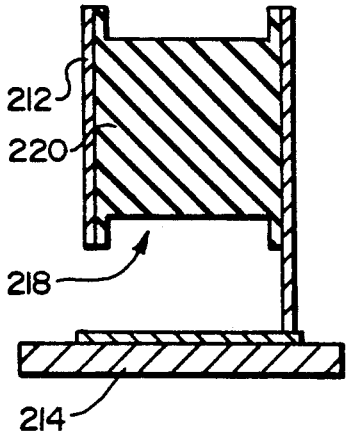
FIGS. 16A, 16B and 16C are views taken along lines 16A, 16B, and 16C of FIG. 15, respectively.
Figure 16B:
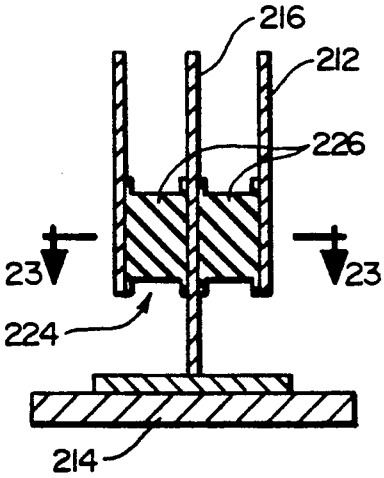
Figure 16C:
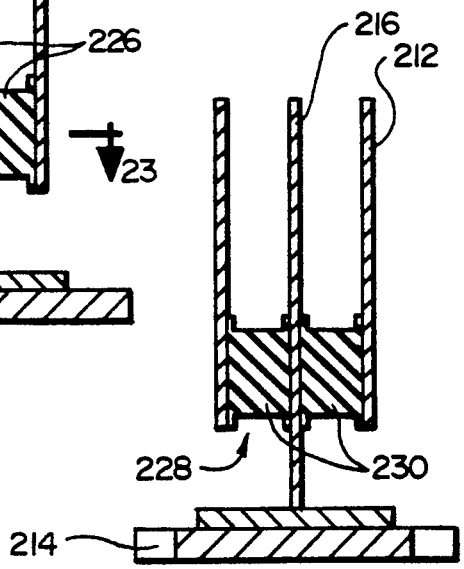
Figure 17:
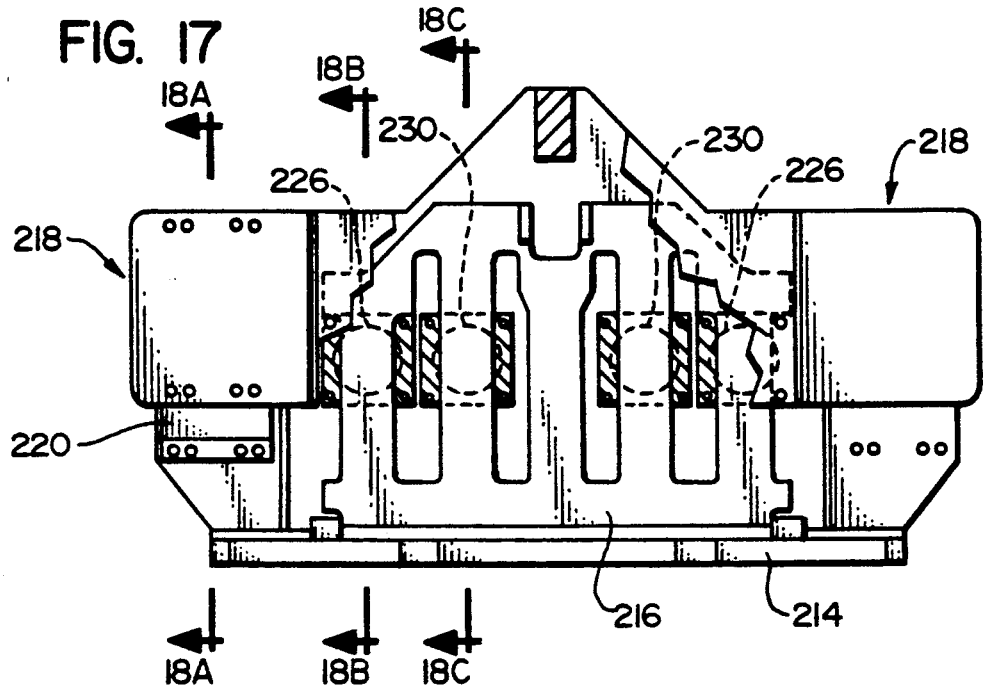
FIG. 17 is a front view of the third embodiment of the present invention in a first mode of operation.

The modes of operation of the apparatus 210 will now be discussed. The apparatus 210 is used in basically the same way as the apparatus 110. FIGS. 16A–C depict the status of the first, second and third sets 218, 224, 228, respectively, of shock absorbing members when no external tension loads are applied on the cable 12.

Figure 18A:
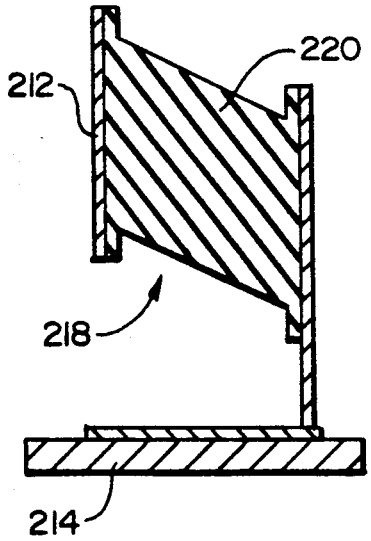
FIG. 18A, 18B, and 18C are views taken along lines 18A, 18B, and 18C of FIG. 17, respectively.
Figure 18B:
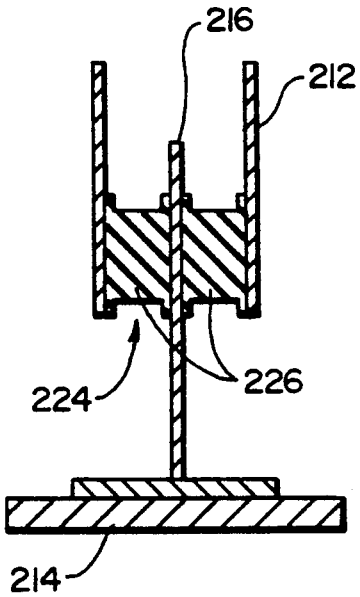
Figure 18C:
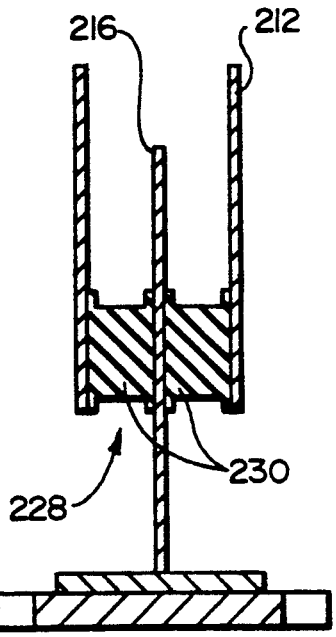
Figure 19:
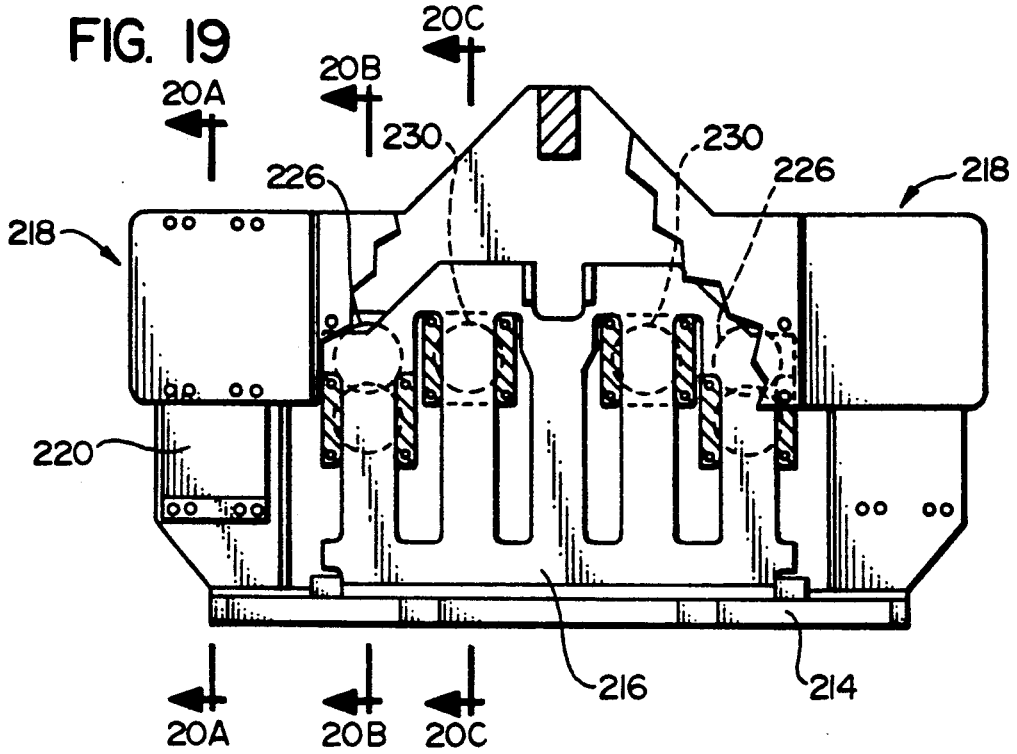
FIG. 19 is a front view of the third embodiment of the present invention in a second mode of operation.

FIGS. 17 and 18A–C depict the apparatus 210 in a first mode of operation. In this first mode, a first, relatively lower range of tension loads are applied on the cable 12. A comparison of FIGS. 15 and 17 reveals that these tension loads cause the base section 214 and connecting section 216 to be displaced downwardly relative to the connecting section 212. Only the first set 218 of shock absorbing members 220 and 222 are distorted by the vibratory forces generated by the vibratory machine 16 (FIGS. 18A–C). Thus, these vibratory forces are absorbed primarily by the first set 218 of shock absorbing members in this first mode of operation.

Figure 20A:
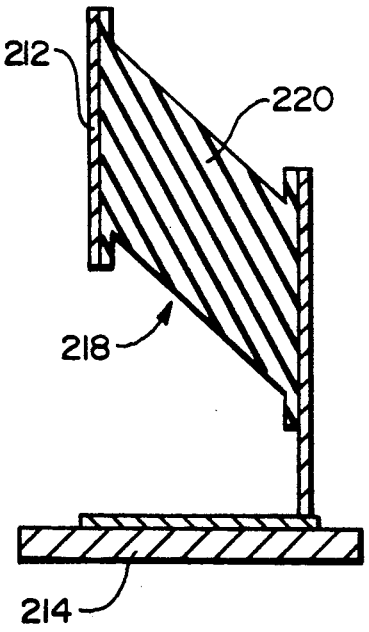
FIGS. 20A, 20B, and 20C are views taken along lines 20A, 20B, and 20C of FIG. 19, respectively.
Figure 20B:
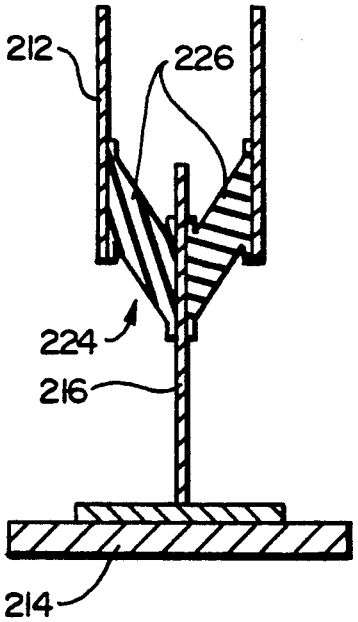
Figure 20C:
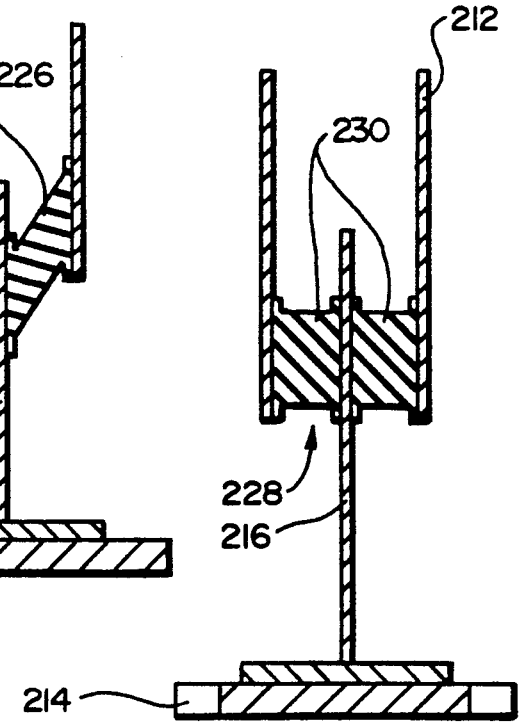
Figure 21:
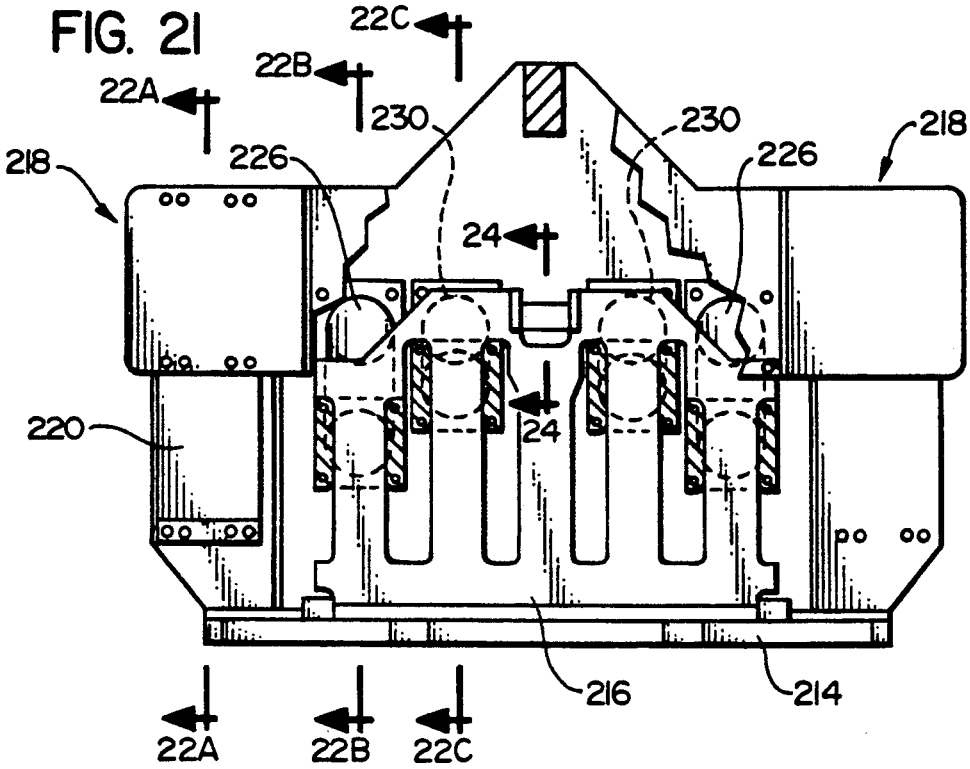
FIG. 21 is a front view of the third embodiment of the present invention in a second mode of operation.

FIGS. 19 and 20A–C depict the apparatus 210 in a second mode of operation. In this second mode, a second, middle range of tension loads are applied on the cable 12. The tension loads in this second range are greater than the tension loads in the first range of loads. A comparison of FIGS. 17 and 19 reveals that these greater tension loads cause the base section 214 and connecting section 216 to be displaced further downwardly relative to the connecting section 212. In this second mode, the spacers 254 contact the intermediate edges 236*c* of the side slots 236 and the upper edges 238*a* of the edge slots 238. Thus, the inner sides of the shock absorbing members 226 are downwardly displaced with further downward displacement of the intermediate section 216 relative to the connecting section 212 (FIG. 20B). The first set 218 and second set 224, but not the third set 226, of shock absorbing members are distorted by the vibratory forces generated by the vibratory machine 16 (FIGS. 20A–C). Because the cumulative shock absorbing capacity of the shock absorbing members 226 is greater than that of the shock absorbing members 220 and 222, the vibratory forces are absorbed primarily by the second set 218 of shock absorbing members in this second mode of operation.

Figure 22A:
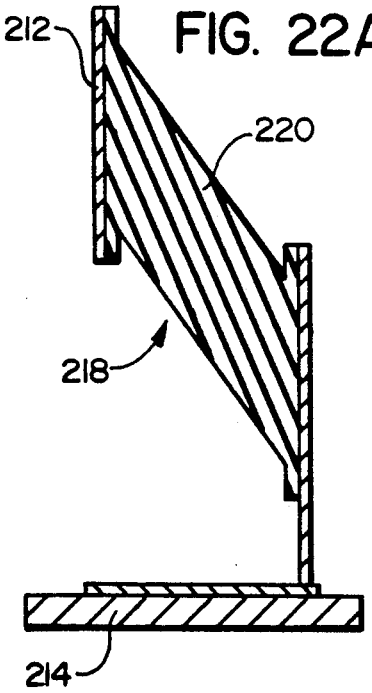
FIGS. 22A, 22B, and 22C are views taken along lines 22A, 22B, and 22C of FIG. 21, respectively.
Figure 22B:
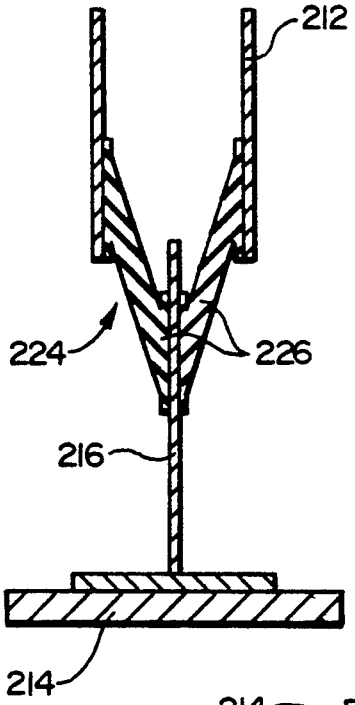
Figure 22C:
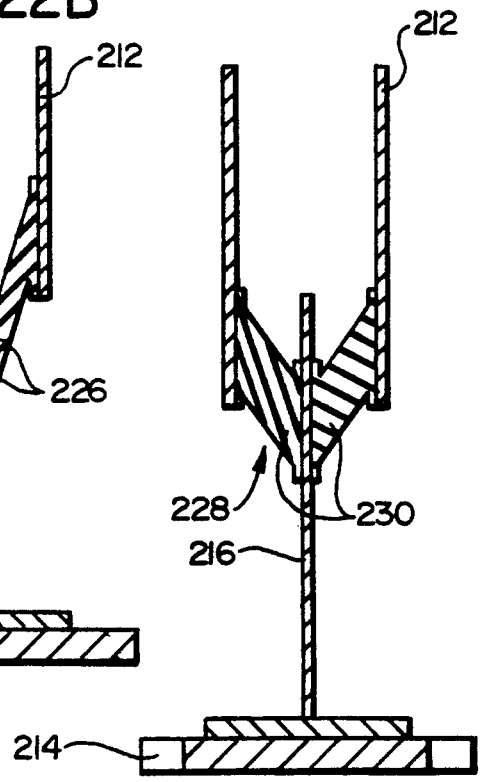

FIGS. 21 and 22A–C depict the apparatus 210 in a third mode of operation. In this third mode, a third, relatively higher range of tension loads are applied on the cable 12. The tension loads in this third range are greater than the tension loads in the second range. A comparison of FIGS. 19 and 21 reveals that these still greater tension loads cause the base section 214 and connecting section 216 to be displaced still further downwardly relative to the connecting section 212. In this third mode, the spacers 254 contact the upper edges 234*a* of the center slot 234 and the upper edges 236*a* of the side slots 236. Thus, downward displacement of intermediate section 216 relative to the connecting section 212 causes distortion of the shock absorbing members 230 of the third set 228 of shock absorbing members (FIG. 22C). The first set 218, second set 224, and third set 228 of shock absorbing members are distorted by the vibratory forces generated by the vibratory machine 16. All of the shock absorbers of the shock absorbing apparatus 210 absorb shock in the third mode, so the vibratory forces are effectively absorbed even for these relatively larger tension loads in this third range of tension loads.

At a predetermined tension load, which corresponds to the maximum load of this third range of loads, the stop bar 244 comes into contact with the stop plate 242. When this occurs, the intermediate section 216 cannot be displaced further downwardly relative to the connecting section 212. The apparatus 210 should not be operated at loads greater than the predetermined tension load at which the stop bar 244 comes into contact with the stop plate 242.

The dynamic characteristics of each of the sets 218, 224, and 226 of shock absorbing members are designed to match the characteristics of the components to which they are to be attached and the expected force loads to be encountered. Such design has not be discussed in detail herein because it is well within the state of the art.

However, it should be noted that the present invention as described in this third embodiment gives the designer great latitude in configuring the present invention for different expected force loads. Specifically, by employing three or more sets of shock absorbing members, the third embodiment allows the total shock absorbing capacity of the apparatus 210 to be incrementally increased as the tension loads are increased. Thus, the shock absorbing capacity of the apparatus 210 over a wide range of loads may be finely tuned to allow optimal shock absorption for expected tension loads.

From the foregoing, it should be clear that the present invention may be embodied in forms other than those disclosed above without departing from the spirit or essential characteristics of the invention. The above-described embodiments are therefore to be considered in all respects illustrative and not restrictive, the scope of the invention being indicated by the appended claims rather than the foregoing description. All changes that come within the meaning and scope of the claims are intended to be embraced therein.

I claim:

1. A shock absorbing apparatus adapted to be connected between a pile driving and/or pile pulling vibratory device which generates a vibratory force and imparts the vibratory force to a pile and a carrying member for supporting the vibratory device, comprising:

a. a base section adapted to be connected to one of the carrying member and the vibratory device;

b. a connecting section adapted to be connected to the other of the carrying member and the vibratory device, where tension loads are applied to the carrying member which causes a relative displacement between the connecting section and the base section;

c. first shock absorbing means connected between the base section and the connecting section for absorbing the vibratory device generated by the vibratory device;

d. second shock absorbing means connected between the base section and the connecting section above a first predetermined load for absorbing the vibratory force generated by the vibrating device;

e. third shock absorbing means connected between the base section and the connecting section above a second predetermined tension load for absorbing the vibratory force generated by the vibrating device; and f. stop means for so limiting relative movement between the base section and the connecting section that, under a third predetermined load, the intermediate and connecting sections come into essentially rigid contact with each other.

2. An apparatus as recited in claim 1, further comprising an intermediate section attached to the base section, in which:

a. the connecting section has a center cavity having front and back inner walls;

b. the second and third shock absorbing means each comprise at least one shock absorbing unit connected between the front and back inner walls of the center cavity; and c. the intermediate section so extends into the center cavity that the at least one shock absorbing unit of the second shock absorbing means extends through at least one corresponding first slot in the intermediate section and the at least one shock absorbing unit of the third shock absorbing means extends through at least one second slot in the intermediate section;

whereby the first slot is formed with at least one edge which contacts and distorts the at least one shock absorbing unit of the second shock absorbing means at tension loads greater than the first predetermined tension load and the second slot is formed with at least one edge which contacts and distorts the at least one shock absorbing unit of the third shock absorbing means at tension loads greater than the second predetermined tension load.

3. An apparatus as recited in claim 2, in which the connecting section further defines first and second end cavities, where the base section has first and second projections that protrude into the first and second end cavities, respectively, and the first shock absorbing means comprises first and second rectangular solid rubber shock absorbing members, where the first rectangular solid shock absorbing member extends from an inner wall of the first end cavity to the first projection and the second rectangular solid shock absorbing member extends from an inner wall of the second cavity to the second projection.

4. A shock absorbing apparatus adapted to be connected between a pile driving and/or pile pulling vibratory device which generates a vibratory force and imparts the vibratory force to a pile and a pulling means for applying a tension load to a carrying member, the shock absorbing apparatus comprising:

a. a base section adapted to be connected to the vibratory device;

b. a connecting section adapted to be connected to the carrying member;

c. a plurality of shock absorbing means for absorbing vibratory force, where a predetermined tension load is associated with each of the plurality of shock absorbing means; and d. means for so connecting each of the shock absorbing means between the base section and the connecting section at the predetermined tension loads associated with the shock absorbing means that i. below a given tension load on the connecting section, at least one of the plurality of shock absorbing means is effective to absorb the vibratory force, and ii. above the given tension load on the connecting section, additional of the shock absorbing means are effective to absorb the vibratory force, 5. An apparatus as recited in claim 4, in which the connecting means connects at least a first shock absorbing means of the plurality of shock absorbing means between the base and connecting sections under all tension loads applied to the carrying member.

6. An apparatus as recited in claim 5, in which the connecting means connects at least a second shock absorbing means of the plurality of shock absorbing means between the base section and the connecting section under a first predetermined load.

7. An apparatus as recited in claim 6, in which the connecting means connects at least a third shock absorbing means of the plurality of shock absorbing means between the base section and the connecting section under a second predetermined load, where the second predetermined load is greater than the first predetermined load.

8. An apparatus as recited in claim 6, in which the connecting means comprises an intermediate plate connected to one of the base section and the connecting section and having at least a first slot formed therein corresponding to the second shock absorbing means, where a contacting portion of the second shock absorbing means so extends through the first slot corresponding thereto that:

a. the contacting portion of the second shock absorbing means moves within the slot when the tension loads are below the first predetermined load; and b. the contacting portion of the first shock absorbing means so engages a contacting surface of the first slot at tension loads equal to and greater than the first predetermined load that the first shock absorbing means also yieldingly absorbs shocks generated by the vibratory device.

9. An apparatus as recited in claim 7, in which the connecting means comprises an intermediate plate connected to one of the base section and the connecting section and having at least a first slot and a second slot formed therein corresponding to the second and third shock absorbing means, respectively, where a contacting portion of the second shock absorbing means extends through the first slot corresponding thereto and a contacting portion of the third shock absorbing means extends through the second slot corresponding thereto so that:

a. the contacting portions of the second and third shock absorbing means moves within their respective slots when the tension loads are below the first predetermined load; and b. the contacting portion of the first shock absorbing means so engages a contacting surface of the first slot at tension loads equal to and greater than the first predetermined load that the second shock absorbing means also yieldingly absorbs shocks generated by the vibratory device; and c. the contacting portion of the second shock absorbing means so engages a contacting surface of the second slot at tension loads equal to and greater than the second predetermined load that the third shock absorbing means also yieldingly absorbs shocks generated by the vibratory device.

10. An apparatus as recited in claim 9, further comprising stop means for limiting relative movement between he base section and the connecting section under a maximum tension load, where the maximum tension load is greater than the second predetermined load.

11. An apparatus as recited in claim 4, further comprising stop means for limiting relative movement between the base section and the connecting section under a maximum tension load.

* * * * *